US005150159A

United States Patent [19]

Igawa et al.

[11] Patent Number: 5,150,159

[45] Date of Patent: Sep. 22, 1992

[54] COPYING MACHINE CAPABLE OF PROVIDING INDEXES

[75] Inventors: Shoji Igawa; Akio Kotani, both of Osaka, Japan

[73] Assignee: Minolta Camera Kabushiki Kaisha, Osaka, Japan

[21] Appl. No.: 703,691

[22] Filed: May 20, 1991

Related U.S. Application Data

[63] Continuation of Ser. No. 424,674, Oct. 20, 1989, abandoned.

[30] Foreign Application Priority Data

Oct. 24, 1988 [JP] Japan ..... 63-267781
Oct. 24, 1988 [JP] Japan ..... 63-267782

[51] Int. Cl.[5] ..... G03G 15/04

[52] U.S. Cl. ..... 355/243; 355/55; 355/218; 355/244

[58] Field of Search ..... 355/202, 204, 206, 208, 355/218, 317, 243, 244, 55, 61; 358/296, 300

[56] References Cited

U.S. PATENT DOCUMENTS 4,530,592 7/1985 Green et al. ..... 355/243
4,758,866 7/1988 Ito ..... 355/61
4,763,159 8/1988 Temple et al. ..... 355/202
4,763,165 8/1988 Watanabe ..... 355/328
4,782,361 11/1988 Spinelli et al. ..... 355/317
4,806,976 2/1989 Kato et al. ..... 355/202

FOREIGN PATENT DOCUMENTS 0161763 10/1982 Japan ..... 355/218
0143785 7/1986 Japan ..... 355/202
0238069 10/1986 Japan ..... 355/218
0246771 11/1986 Japan ..... 355/218
0290472 12/1986 Japan ..... 355/218
0115433 5/1987 Japan ..... 355/218
0019369 1/1989 Japan ..... 355/218

*Primary Examiner*—A. T. Grimley
*Assistant Examiner*—J. E. Barlow, Jr.
*Attorney, Agent, or Firm*—Willian, Brinks, Olds, Hofer, Gilson & Lione

[57] ABSTRACT

A copying apparatus has a photoreceptor drum, a charger for charging the photoreceptor drum, an exposure lamp for exposing images to said photoreceptor drum, an apparatus for setting magnification rate of the images, a selector for selecting a first mode in which the images are exposed to the photoreceptor drum in the set magnification rate or a second mode in which the images are exposed to said photoreceptor drum in a magnification rate smaller than the set magnification rate, an apparatus for partially removing the charges of an unexposed portion adjacent to the latent electrostatic images formed on the photoreceptor drum when the second mode is selected, and a developer for developing the latent electrostatic images and the unexposed portion. When the second mode is selected, an index is formed by the removal of the charges at the unexposed portion adjacent to the latent electrostatic images formed on the photoreceptor drum.

16 Claims, 24 Drawing Sheets

FIG.10

| PAPER SIZE \ ORIGINAL SIZE | A 3 | B 4 | A 4 | B 5 | A 5 |
|---|---|---|---|---|---|
| | 297 x 420 | 257 x 364 | 210 x 297 | 182 x 257 | 148 x 210 |
| A 3 | 0.966 / 1.000 | 1.117 / 1.156 | 1.367 / 1.414 | 1.577 / 1.632 | 1.939 / 2.000 |
| B 4 | 0.832 / 0.865 | 0.961 / 1.000 | 1.176 / 1.224 | 1.357 / 1.414 | 1.669 / 1.736 |
| A 4 | 0.673 / 0.707 | 0.778 / 0.817 | 0.952 / 1.000 | 1.099 / 1.154 | 1.351 / 1.414 |
| B 5 | 0.579 / 0.613 | 0.669 / 0.707 | 0.819 / 0.866 | 0.945 / 1.000 | 1.162 / 1.230 |
| A 5 | 0.465 / 0.500 | 0.537 / 0.576 | 0.657 / 0.707 | 0.758 / 0.813 | 0.932 / 1.000 |

INDEX FORMING MAGNIFICATION RATE / NORMAL MAGNIFICATION RATE

INDEX SIZE (WHEN INDEX WIDTH d = 5mm)

FIG.13

| PAPER SIZE | A 3 | B 4 | A 4 | B 5 | A 5 |
|---|---|---|---|---|---|
| 33a 11 | O | O | O | O | O |
| a 10 | O | ↕ | ↕ | ↕ | ↕ |
| a 9 | × | O | ↕ | ↕ | ↕ |
| a 8 | ↕ | Δ | ↓ | ↕ | ↕ |
| a 7 | ↕ | × | O | ↕ | ↕ |
| a 6 | ↕ | ↕ | Δ | ↓ | ↕ |
| a 5 | ↕ | ↕ | × | O | ↕ |
| a 4 | ↕ | ↕ | ↕ | Δ | ↓ |
| a 3 | ↕ | ↕ | ↕ | × | O |
| a 2 | ↕ | ↕ | ↕ | ↕ | Δ |
| 33a 1 | ↕ | ↕ | ↕ | ↕ | × |
| 33b 1 | ↕ | ↕ | ↕ | ↕ | × |
| b 2 | ↕ | ↕ | ↕ | ↓ | T |
| b 3 | ↕ | ↕ | ↕ | × | O |
| b 4 | ↕ | ↕ | ↓ | T | ↕ |
| b 5 | ↕ | ↕ | × | O | ↕ |
| b 6 | ↕ | ↓ | T | ↕ | ↕ |
| b 7 | ↕ | × | O | ↕ | ↕ |
| b 8 | ↓ | T | ↕ | ↕ | ↕ |
| b 9 | × | O | ↕ | ↕ | ↕ |
| b 10 | T | ↕ | ↕ | ↕ | ↕ |
| 33b 11 | O | O | O | O | O |

O··· ON  ×···OFF  T···TIMING CONTROL

Δ··· NORMALLY OFF, ON FOR FORMING INDEX

COPYING MACHINE CAPABLE OF PROVIDING INDEXES

This application is a continuation of application Ser. No. 07/424,674, filed Oct. 20, 1989, now abandoned.

BACKGROUND OF THE INVENTION

1. Field of the Invention

The present invention relates to a copying machine capable of forming indexes on sheets of copy paper and, more specifically, to a copying machine capable of forming an index in one copying operation.

2. Description of the Related Art

When copied sheets are filed and indexes are needed, generally, index tags are applied at end portions of necessary pages of the filed copies, with the tags projecting outward.

The provision of indexes in the conventional manner, that is, the application of the index tag was time consuming and troublesome, since the index tags must be applied one by one to the copied documents. In addition, since the applied index tags are projecting outward from the filed document, they are easily damaged. Therefore, when the index tag is weaker than the copied sheet of paper, the index tag itself is damaged, and otherwise the portion of the copied sheet near the index tag may be damaged. In either case, it was difficult to use the index tags for a long period of time.

SUMMARY OF THE INVENTION

Therefore, one object of the present invention is to form a mark which can serve as an index at a desired position on the periphery of a sheet of paper simultaneously with the formation of images in an image forming apparatus such as a copying machine.

Another object of the present invention is to form an index on a sheet of copy paper in a simple manner simultaneously with the copying operation in a copying machine.

A further object of the present invention is to form character information simultaneously with the formation of the index in a copying machine.

A still further object of the present invention is to form an index including character in a copying machine.

The above described objects of the present invention can be attained by an image forming apparatus, such as a copying machine, of the present invention for forming images on a sheet of paper, comprising, a photoreceptor having a central portion and peripheral portions, an apparatus for charging the photoreceptor, and an apparatus for exposing the images on the photoreceptor. Latent electrostatic images are formed on the photoreceptor by the exposure. The image forming apparatus further comprises an apparatus for setting magnification of the images, and selecting means for selecting either a first mode in which the images are exposed on the photoreceptor in a set magnification, or a second mode in which the images are exposed on the photoreceptor at a magnification smaller than the set magnification. In the second mode, an unexposed portion is left at the peripheral portion of the photoreceptor. The image forming apparatus further comprises an apparatus for erasing at least part of the charges on the unexposed portion formed on the photoreceptor when the second mode is selected, and an apparatus for developing the latent electrostatic images and the unexposed portion.

Since the image forming apparatus of the present invention comprises the above described components, an image having the density different from those of other portions is formed at the peripheral portion of the sheet of paper in the second mode. Therefore, a mark portion which can serve as an index can be formed at a desired portion of the peripheral portion of the sheet on which the images are formed, simultaneously with the formation of the images.

Preferably, the image forming apparatus comprises a copying apparatus, a latent electrostatic image for the index is formed by the removal of the charges at the unexposed portion on the photoreceptor, and the developing apparatus comprises an apparatus for changing the latent electrostatic images formed on the photoreceptor and the latent electrostatic image for the index adjacent thereto into toner images. The copying apparatus further comprises an apparatus for transferring the toner images onto a sheet of copy paper.

Since the copying apparatus comprises the above described components, a region for the index is formed on the sheet of copy paper, and a toner image is formed on a portion thereof. Consequently, an index can be formed in a simple manner on a sheet of copy paper simultaneously with the copying operation in the copying apparatus.

More preferably, the removing apparatus comprises an erasing apparatus for removing the charges on the photoreceptor, and a .controlling apparatus for controlling the timing of lighting the erasing apparatus and the on time of the erasing apparatus. The removing apparatus further comprises a character generating apparatus for outputting a character generating signal for generating a prescribed character, and the controlling apparatus controls the erasing apparatus in synchronization with the character generating signal. Since the copying apparatus comprises the above described components, a prescribed character image is formed on the index region on the sheet of copy paper. Consequently, an index including characters can be formed in the copying apparatus.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 10 shows a relation between the index forming magnification rate and a normal variable magnification rate;

FIG. 13 illustrates operation of elements constituting the eraser unit at different paper sizes;

DESCRIPTION OF THE PREFERRED EMBODIMENTS

(1) First Embodiment

Figure 1:
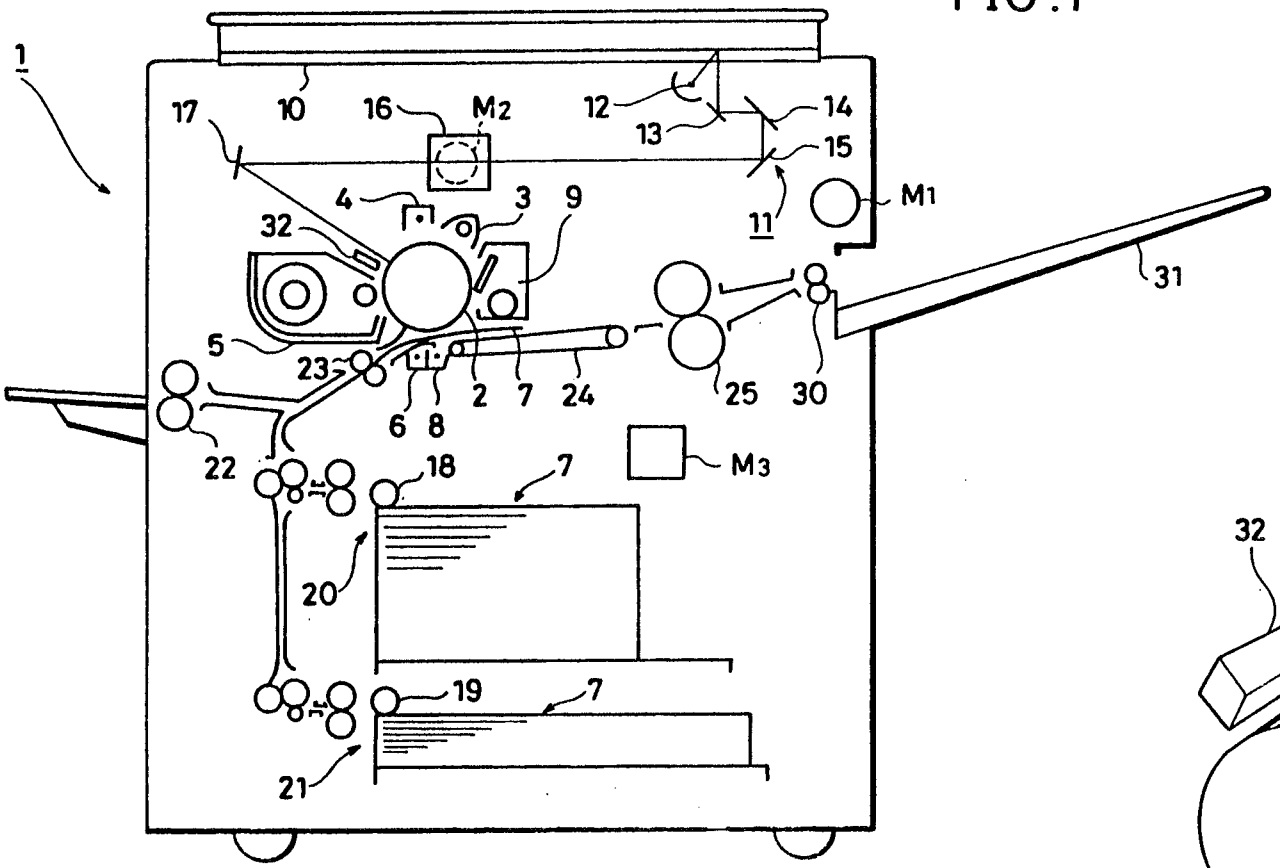
FIG. 1 is a cross sectional view showing a schematic structure of a copying machine.

Referring to FIG. 1, an electrophotographic copying machine in accordance with the present invention comprises a photoreceptor drum 2 positioned approximately at the center of a body 1, which drum is driven counterclockwise. Around the photoreceptor drum 2, successively arranged are a main eraser lamp 3, a main corona charger 4, a developing apparatus 5, a transfer charger 6, a separating charger 8 for separating a sheet of copy paper 7 from the photoreceptor drum 2, a cleaning apparatus 9 and so on.

The photoreceptor drum 2 comprises a photosensitive layer provided on the surface thereof. The photosensitive layer is charged as it passes through the main eraser lamp 3 and the main corona charger 4, and images are exposed by an exposing optical system 11 provided below a platen glass 10 on the upper surface portion of the body 1. The exposing optical system comprises a light source 12, movable mirrors 13, 14 and 15, a projection lens 16 and a mirror 17. The light source 12 and the movable mirror 13 moves to the left at a speed of (V/N) (N: copying magnification rate) with the peripheral velocity of the photoreceptor drum 2 being V (which is constant regardless of the equal scale magnification or valuable scale magnification). The movable mirrors 14 and 15 move to the left at the speed of (V/2N). These are driven by a DC motor M1. Images of an original on the platen glass are scanned by the optical system, so that the images are slit-exposed on the photoreceptor drum 2. When the copying magnification rate is to be changed, the projection lens 16 moves on the optical axis and the mirror 17 is moved or swung by the stepping motor M2.

Paper feeding portions 20 and 21 having paper feeding rollers 18 and 19, respectively, are arranged at a lower portion of the body 1, so that the sheets of copy paper 7 are fed to a transferring portion between the photoreceptor drum 2 and the transfer and separation chargers 6 and 8. A manual paper feeding portion 22 is also provided above the paper feeding portions 20 and 21. A timing roller pair 23 for providing the timing of paper feeding is provided immediately preceding the transferring portion. A conveyor belt 24 for conveying the sheet of copy paper 7 on which the toner images are transferred from the photoreceptor drum 2, a fixing apparatus 25 and a discharging roller pair 30 are provided behind the transferring portion. The sheet of copy paper 7 on which the toner images are transferred is subjected to the fixing operation in the fixing apparatus 25, and then it is discharged to a discharging tray 31 out of the body 1 through a discharging roller pair 30.

In addition, an eraser unit 32 is provided at a position between an exposing portion around the photoreceptor drum 2 and the developing apparatus 5. When operated, the eraser unit 32 removes charges on the photoreceptor drum 2 provided by the corona charger 4, thereby erasing the latent electrostatic images at the portion where the charges are removed, so as to prevent development. This is usually used for preventing formation of any image between the images formed on the photoreceptor drum 2.

Figure 2:
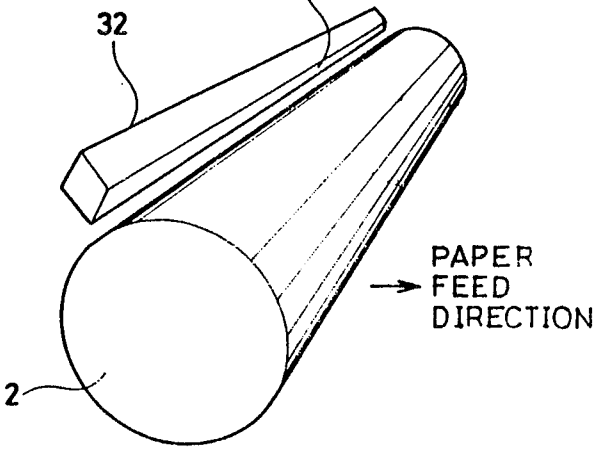
FIG. 2 is a perspective view showing a relation between an eraser unit and a photoreceptor drum.

The eraser unit 32 comprises light emitting diodes (hereinafter referred to as LEDs) which are the erasing elements arranged in the axial direction of the photoreceptor drum 2, as shown in FIG. 2. By controlling and setting the timing of lighting, on time, and the number of LEDs, the latent electrostatic images on the photoreceptor drum 2 are formed, the images at arbitrary portions in the normal image forming region can be erased, and the index can also be formed.

Figure 3:
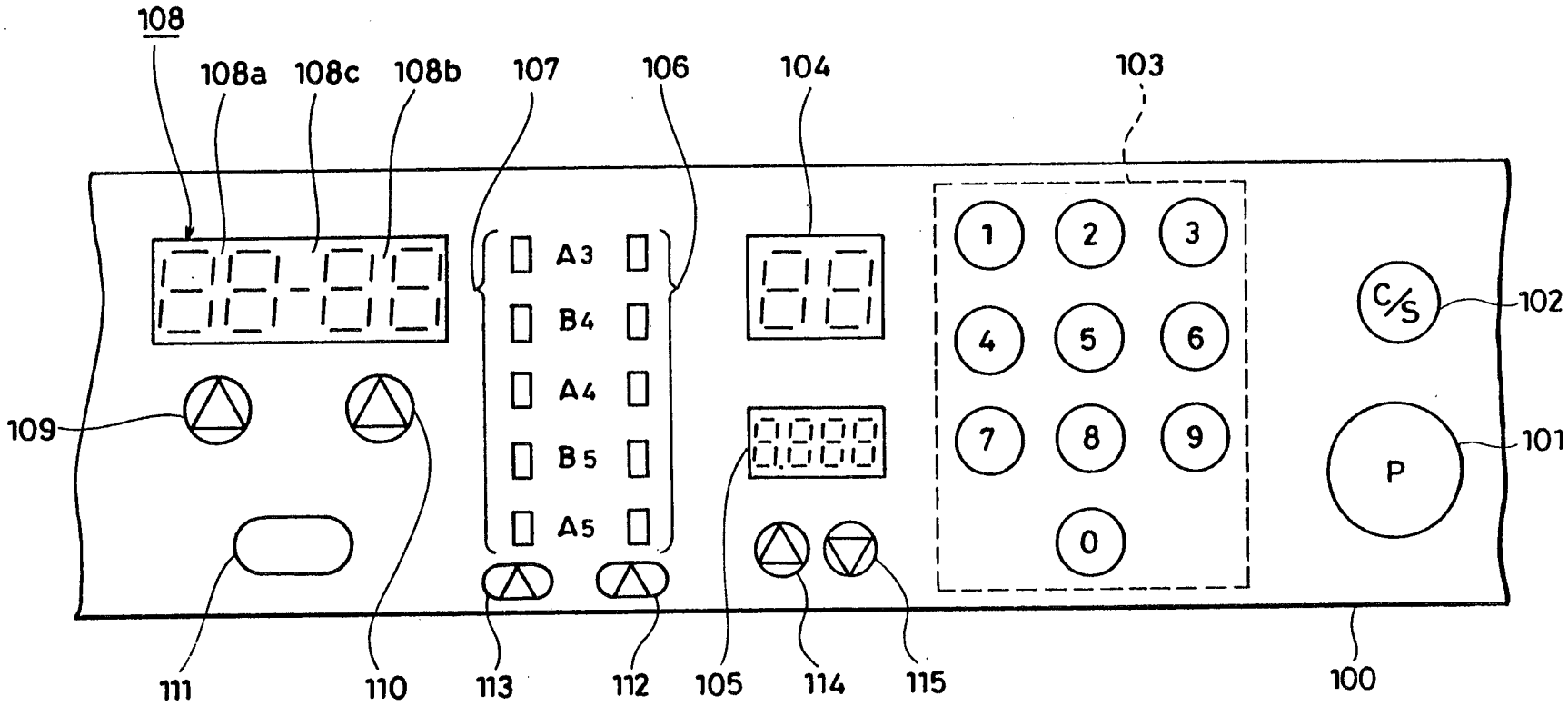
FIG. 3 is a partial plan view of an operation panel in accordance with a first embodiment of the present invention.

Referring to FIG. 3, on the operation panel 100 arranged are a print key 101 for starting the copying operation, a clear stop key 102 for initializing the number of copies and for stopping the multiple copying, and ten keys 103 for setting the number of copies and for setting index division and index number which will be described later. A number displaying portion 104, a magnification rate displaying portion 105 displaying the copying magnification rate, zooming magnification up key 114 and down key 115 are further provided on the operation panel 100. The paper size displaying portion 106 displays the size of the selected sheet by lighting the displaying LEDs. A paper size selecting key 112 is provided for selecting the paper size in a rotary manner. An original size displaying portion 107 displays the size of the original inputted through the original size key 113 of the rotary type, by lighting the LEDs.

An index displaying portion 108 comprises an index division displaying portion 108*a*, an index position displaying portion 108*b* and an index forming mode displaying portion 108*c* indicating the selection of the index forming mode. An index division setting key 109 for setting how many the portion for forming the index is to be divided into, an index positions setting key 110 for setting where the index is to be formed, and an index formation mode selecting key 111 are provided.

Figure 4:
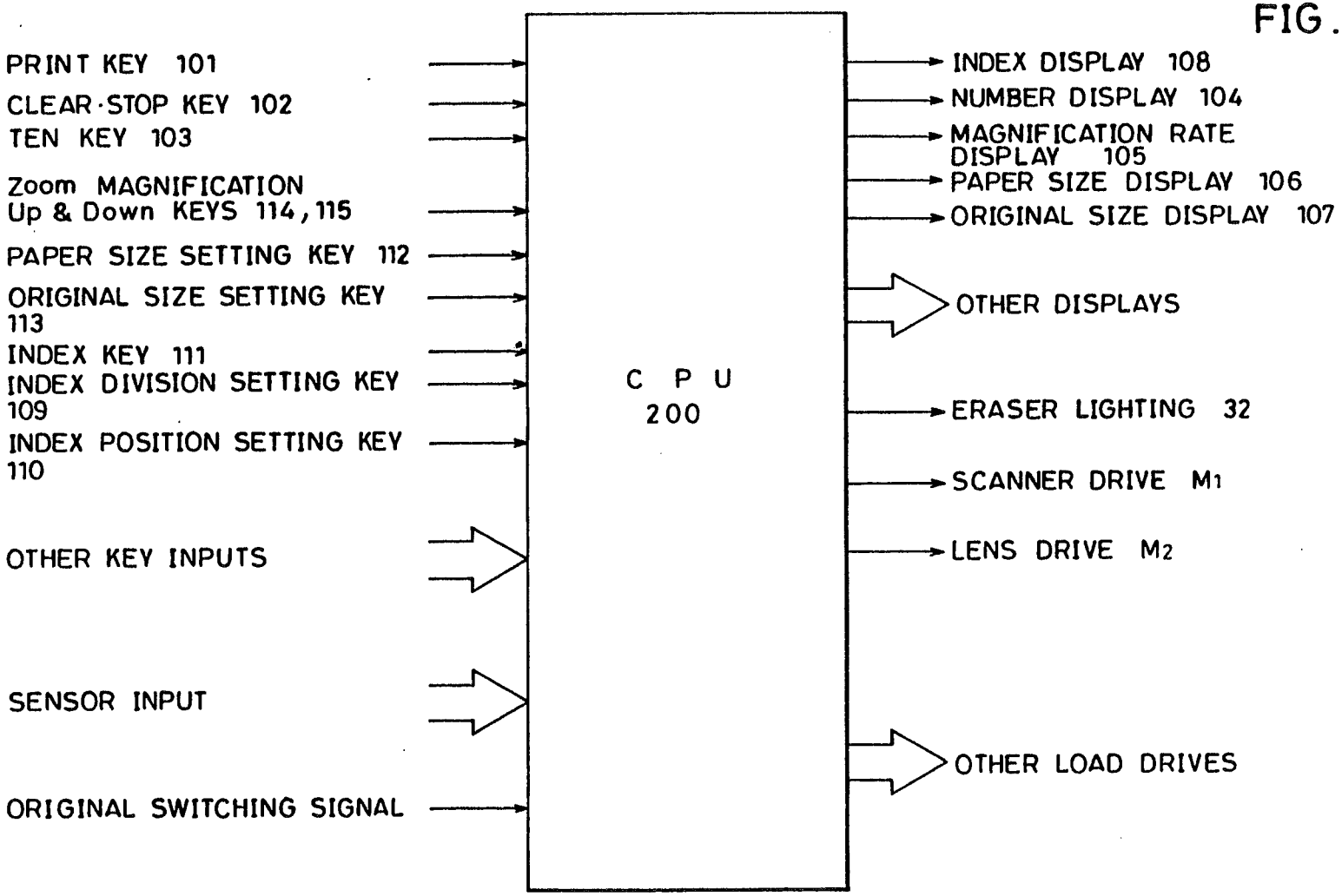
FIG. 4 shows inputs and outputs of signals to and from a CPU in accordance with the first embodiment of the present invention.

Referring to FIG. 4, various key inputs through the operation panel 100 and sensor inputs to the CPU 200 of the copying apparatus and the displaying output, control signal output, driving signal output and so on based on the inputs will be described in the following. The copying machine carries out the copying operation based on the timing control governed by the CPU 200.

Figure 5:
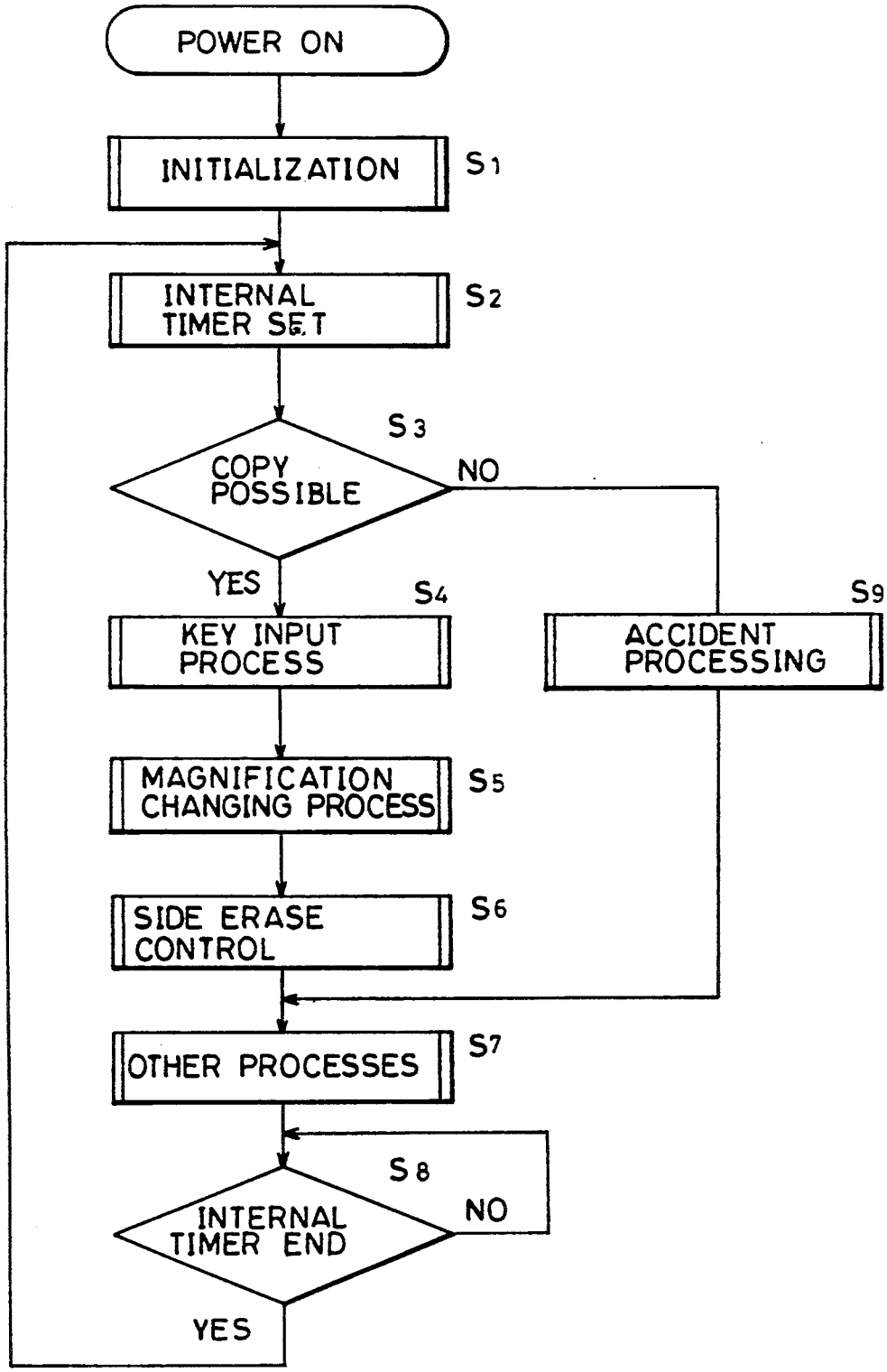
FIGS. 5 to 9 are flow charts in relation to the control in accordance with the first embodiment of the present invention.

Referring to FIG. 5, the control routine of the CPU 200 will be described.

First, in the step S1 (hereinafter the term "step" will be omitted), the program starts as the power is turned on, and initialization such as resetting of the internal RAM is carried out. In S2, an internal timer defining the routine time of the program is set. In S3, whether or not the copying operation is possible is determined. If it is possible (YES), respective steps S4 to S8 are carried out. In S4, a key input processing in accordance with the key inputs of the various keys on the operation panel 100 is carried out; in S5, magnification changing process for setting the copying magnification rate corresponding to the copying mode is carried out; in S6, a side erasing control process for forming the index by controlling the turning on of the erasing elements 33 constituting the erasing means is carried out; and in S7, various displays on the operation panel 100, temperature adjustment and driving controlling process of respective elements related to the copying operation such as the corona charger and the developing unit and so on are carried out. In S8, the program waits for the completion of the internal timer operation, and the program returns to S2. If it is determined that the copying operation is impossible in S3, then the program proceeds to S9 to cope with the accident.

Figure 6A:
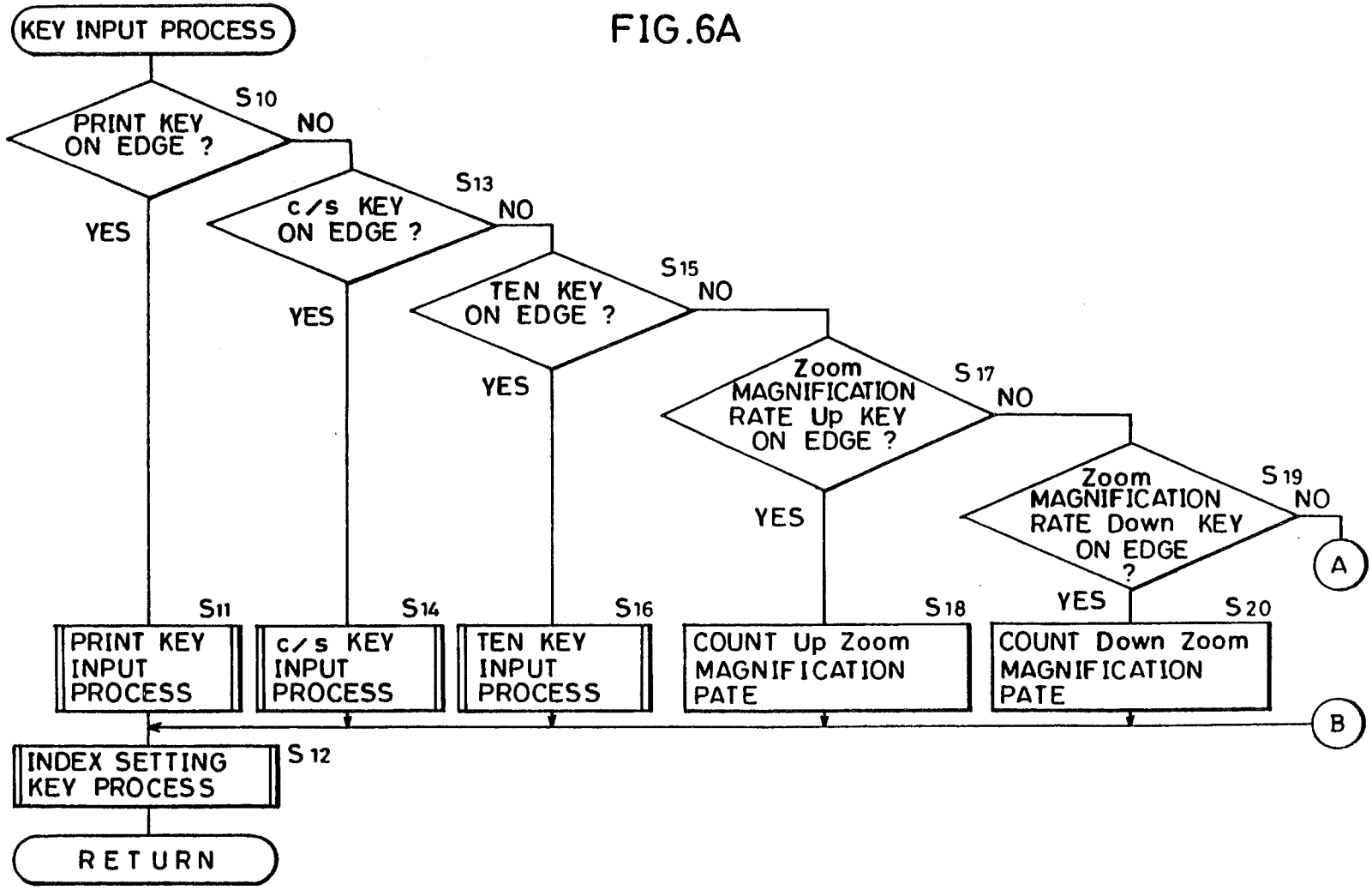
Figure 6B:
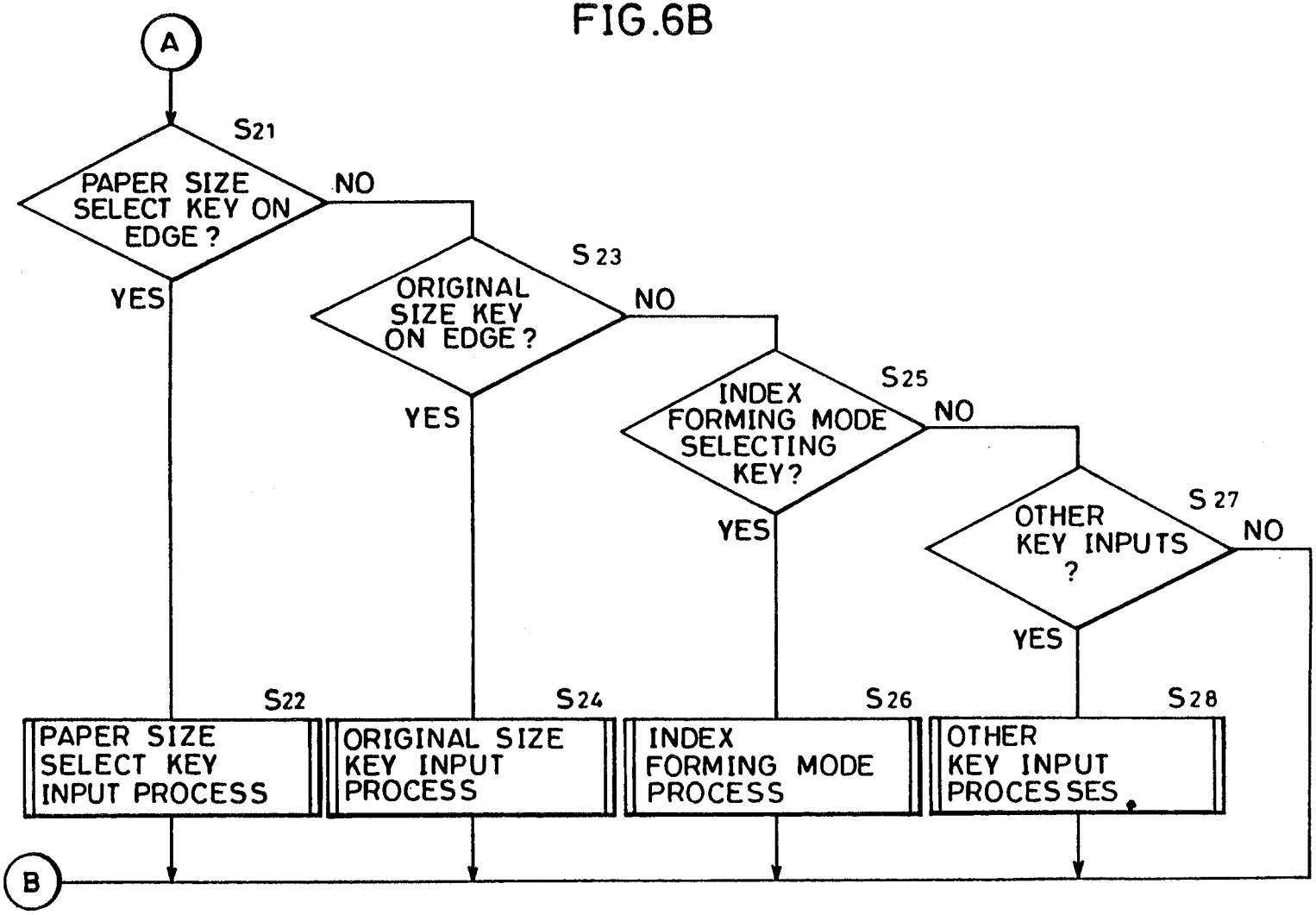

The key input processing routine will be described with reference to FIGS. 6A and 6B. In the following paragraphs, the term "on edge" is defined as change in status where a switch, a sensor, a signal or the light changes from the off status to on status. In contrast, the term "off-edge" represents change in status where a switch, a sensor, a signal or the light changes from the on status to the off status.

In the print key input process (S10, S11) a copy flag, not shown, is set to start the copying operation.

In the clear stop key input process of the steps S13 and S14, initialization of the number of multiple copying and stopping of the multiple copying are carried out. On this occasion, if the index forming mode of the steps S25 and S26 is selected, then the number of index division and the index position are initialized. In the steps S15 to S25, input process through the ten keys 103, the zoom magnification up key and down key 114 and 115, the paper size selecting key 112 and the original size key 113 are carried out, respectively. In the index forming mode selecting key input process in S25 and S26, whether or not the index forming mode selecting key is turned ON is checked.

Figure 7:
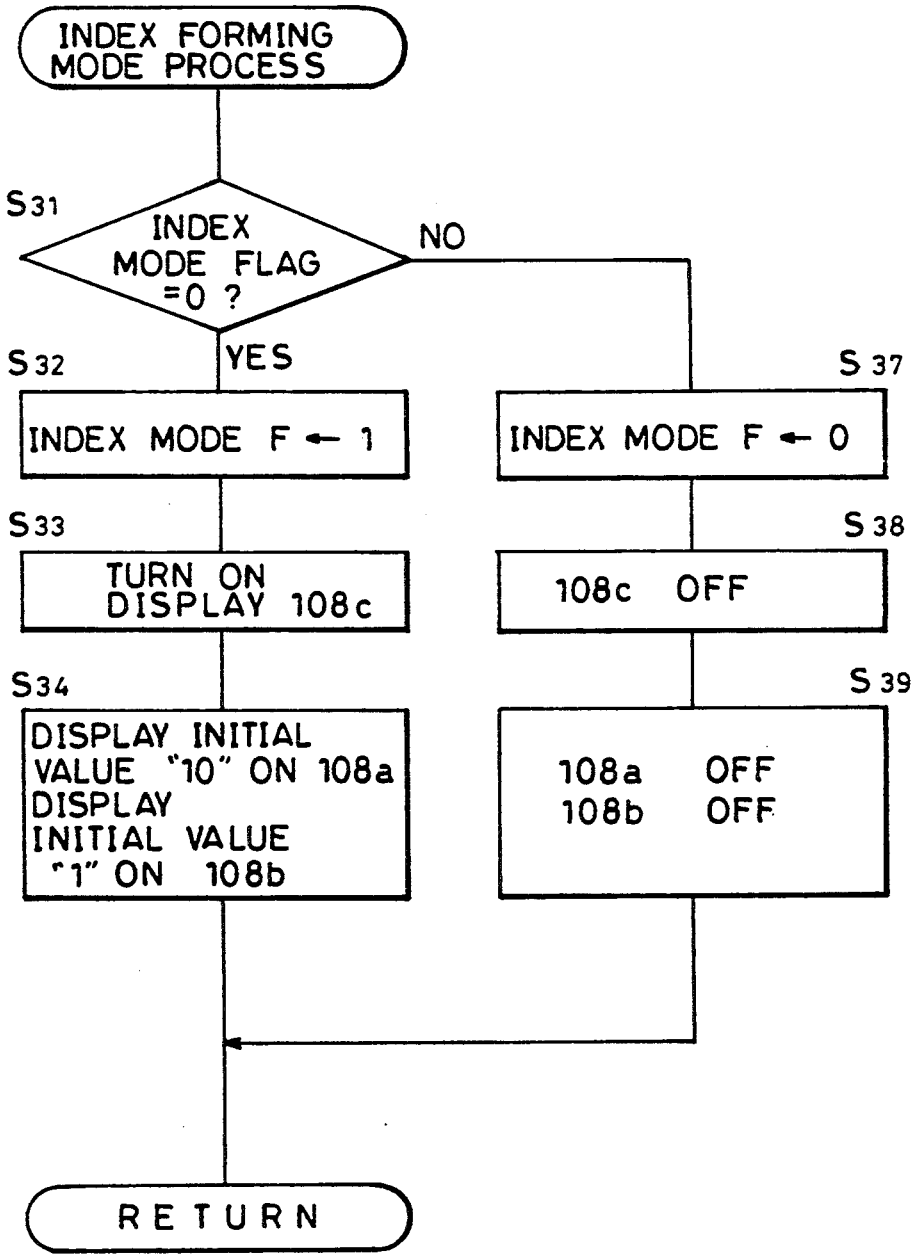

The index forming mode process shown in the step 26 of FIG. 6B will be described with reference to FIG. 7. In the index forming mode process, whether or not the index mode flag is set is determined (S31). If it is determined that the index mode flag is not set in S31, then the index mode flag is set (S32). Then, the index formation mode displaying portion 108*c* shown in FIG. 3 is turned ON (S33). Thereafter, an initial value 10 is displayed on the index division displaying portion 108*a* of the operation panel 100 in S34 and an initial value 1 is displayed on the index position displaying portion 108*b*. Then, the program returns to the main flow. If the index mode flag is set in S31, then the index mode flag is reset (S37) and the index forming mode displaying portion 108*c* is turned OFF (S38). Thereafter, the index division displaying portion 108*a* and the index position displaying portion 108*b* are both turned OFF (S39). Then the program returns to the main flow.

The index forming mode is selected by turning ON the said mode selecting key 111. The mode is repeatedly set and cancelled every time the selecting key 111 is turned on. Whether or not the index forming mode is set is displayed by turning ON/OFF the displaying LED 108*c*.

The index setting key process routine will be described in the following with reference to FIG. 8. First, whether or not the index mode flag is set is determined (S40). If it is determined in S40 that it is set, then the program proceeds to S41. Otherwise, the program directly returns to the main flow. In S41, whether or not there is an ON edge of the index division setting key 109 is checked. If there is (YES in S41), then the program proceeds to the steps S42 and S43.

In the step S42, the number set by the ten key 103 at the number displaying portion 104 at present is stored as the index division number m. Thereafter, the program proceeds to S43 in which the division number m is displayed in the index division displaying portion 108*a*. The division number is kept in the CPU200 until the power supply of the CPU200 is stopped or until a new division number is set. When the power is turned on, 10 is initially set as the division number m.

When it is NO in S41, the program proceeds to S44 in which whether or not there is a key input through the index position setting key 110. If there is the key input, the program proceeds to S45 in which the number set in the number setting portion 104 is stored as the index position n, and the number n indicating the position is displayed in the index position displaying portion 108*b* (S48).

The index division m indicates how many the index region of the copy paper is to be divided into. The index position n indicates the order of positioning the index, that is, which of the regions defined by the index division number is used for forming the index, counting from the upper end. The initial values are 10 and 1, respectively.

The index number n must be no more than the index division number m, so that whether $n>m$ or not is determined in steps S46 and S47. If $n>m$, then the value n is determined as $n=n-m$, so as to prevent erroneous setting of the index position. The index position is set by the index position setting key 110. The index position may be adapted to be counted up from the set value automatically every time the print key 101 is pressed or every time a new original is conveyed onto the platen glass by an automatic document feeding apparatus such as an ADF in response to the conveyer signal. When 20 originals are copied with the index division number m being set at 10, then the index positions circulate twice as 1, 2, 3 . . . 9, 10, 1, 2, . . . 8, 9, 10.

Figure 9:
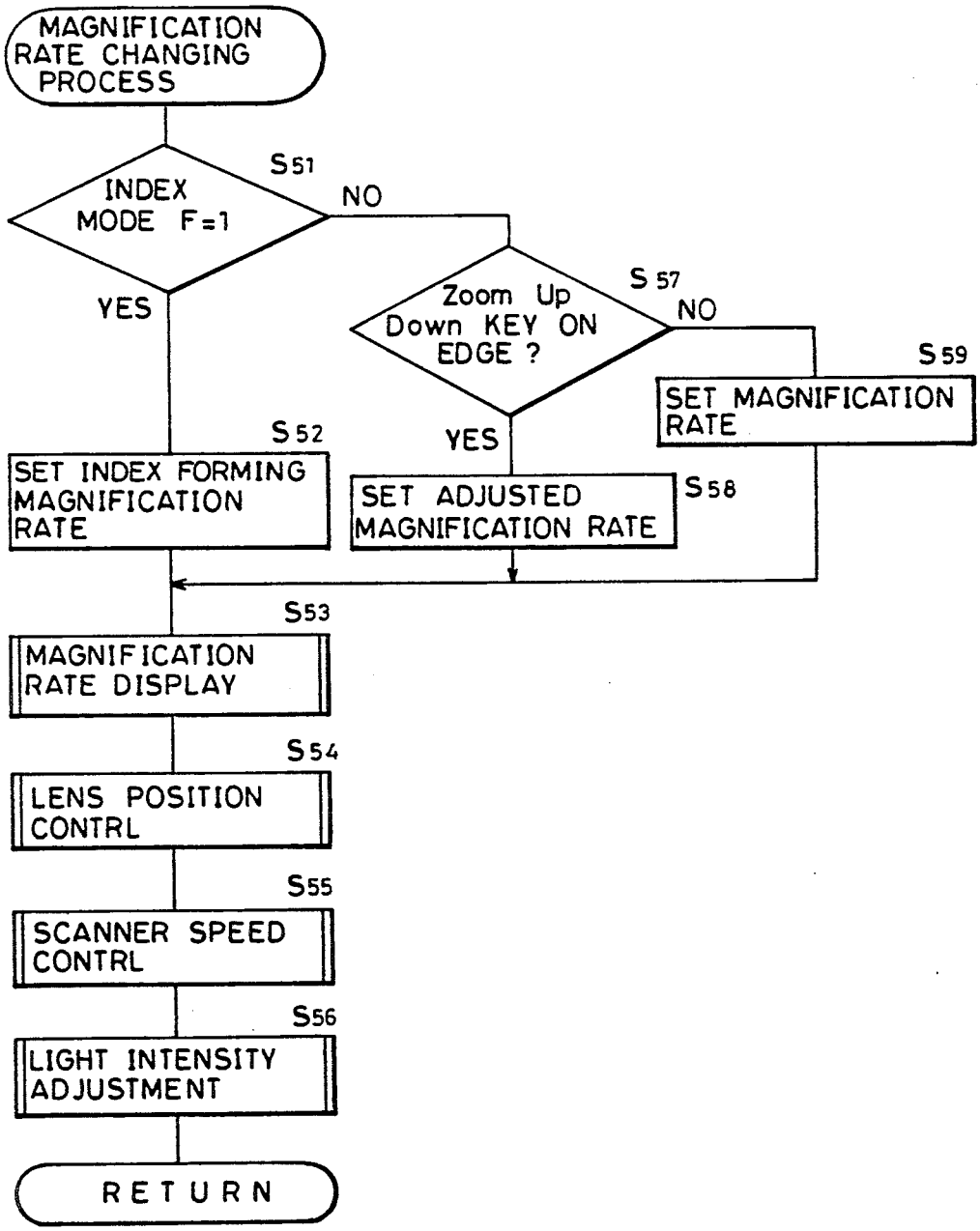

The magnification changing of process routine will be described with reference to FIG. 9. When the index mode flag is set in S51, then the program proceeds to S52 in which the index forming magnification rate is set. If the index forming mode flag is not set, then the program proceeds to S57 in which whether there is a key input through the zoom magnification rate up key 114 or down key 115 or not. If there is the key input, the program proceeds to S58 in which the magnification rate is set in accordance with the adjusted magnification rate provided by the zoom magnification rate up key 114 or the down key 115. If it is NO in S57, then the program proceeds to S59 in which the magnification rate which is automatically calculated based on the presently set original size and the paper size is selected. After the magnification rate is set in either of the above described manners, the program proceeds to S53 to 56.

In the steps S53 to S56, the set magnification rate is displayed on the magnification rate displaying portion 105 of the operation panel, the lens position is controlled in accordance with the magnification rate, the scanner speed is controlled, and the intensity of light is adjusted, respectively.

The index forming magnification rate is set to be slightly lower than the normal copying magnification rate in order to ensure the provision of the index portion.

Examples of the index forming magnification rate are shown in FIG. 10. Referring to FIG. 10, the magnification rates based on the original size and the paper size are shown, with the reference position of copy paper feeding being the center. Normally, the magnification rate is 1, when the original size is the same as the paper size. The normal magnification rates are set in accordance with the original size and the paper size. If the index is to be formed, a region in which the index is formed must be provided on one end of the copy paper, so that the index forming magnification rate is set to be smaller than the normal magnification rate. Consequently, an unexposed zone is formed as a frame around the latent electrostatic images of the original formed reduced on the photoreceptor drum 2. A prescribed portion of the frame-like unexposed zone is erased by the eraser unit 32. Consequently, an index is formed.

As described above, a prescribed unexposed portion must be provided to form an index. If the original has a normal size and not the largest possible copy size, then images are formed by the light reflected from the rear surface of the original cover around the original, when the original is exposed. Therefore, if the rear surface of the original cover is white, light reflected therefrom irradiates the photoreceptor. Consequently, the charges on the photoreceptor may be erased. In order to solve such a problem, the rear surface of the original cover may be made black or it should be made to have mirror surface. Instead of the above, a charging apparatus may be provided so as to recharge the side portion of the photorecepter.

In the above described embodiment, the normal magnification rates and the index forming magnification rates are stored in the form of a table as shown in FIG. 10, corresponding to the original size and the paper size. Alternatively, only the normal magnification rates determined based on the original size and the paper size may be stored and the index forming magnification rate may be calculated based on the stored magnification rate.

Figure 11:
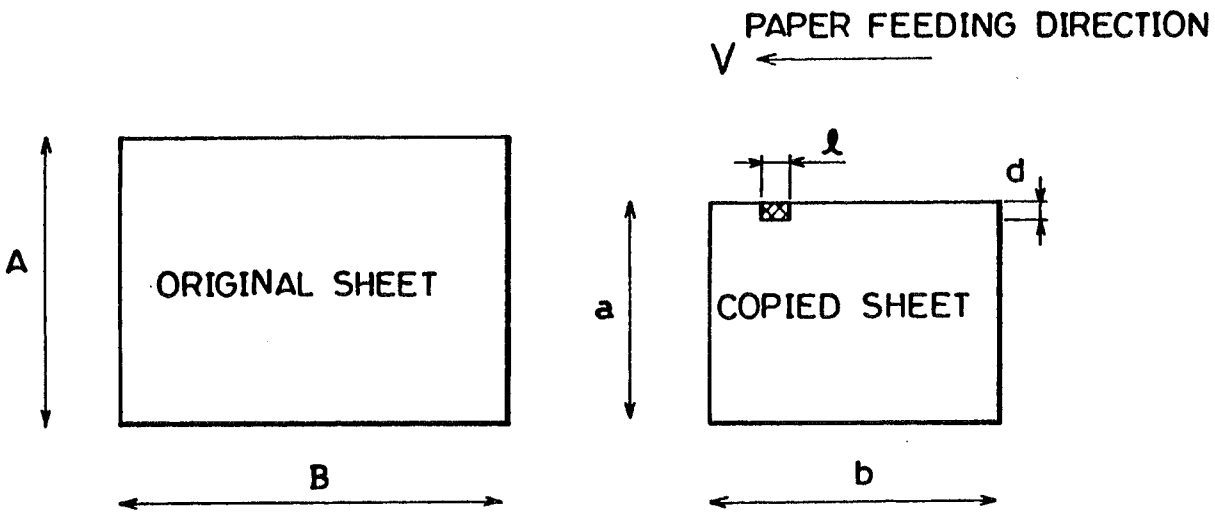
FIG. 11 shows a method of calculating the index forming magnification rate.

Referring to FIG. 11, the method of calculating the index forming magnification rate will be described. The length and width of an original are represented by A and B, respectively, the length and width of the paper are represented by a and b, respectively, the paper feeding direction is represented by an arrow, and the paper feeding speed is represented by v. The width of the index is represented by d, the index length is represented by l the index division number is represented by m and the index position is represented by n.

Now, when the front and rear edge portions, for example 15 mm in width of the paper in the paper feeding direction are not used for forming the index, the index length l will be calculated in the following manner.

$$l=(b-15\times 2)/m \quad (1)$$

The copying magnification rate Z will be $$Z=a/A=b/B \quad (2)$$

When the reference position (hereinafter referred to as a paper feeding reference) for conveying the copy paper is the center, the index magnification rate Zin will be $$Zin=(a-2d)/A \quad (3)$$

The index formation starting time Tst is calculated as follows from the time when the front edge of the paper passes through the eraser unit 32, $$TST=\{15+l(n-1)\}/v \quad (4)$$

Similarly, the index formation time interval Tin will be $$Tin=l/v \quad (5)$$

Now, at the time of the index formation starting time Tst, when the erasing element 33 corresponding the unexposed zone of the eraser unit 32 is kept off for the index formation time interval Tin, then a black index having the length l is formed. On the contrary, if the eraser element 33 is kept on for the time interval Tin, a white index against black background is formed, which is the inverse of the above mentioned index.

Figure 12:
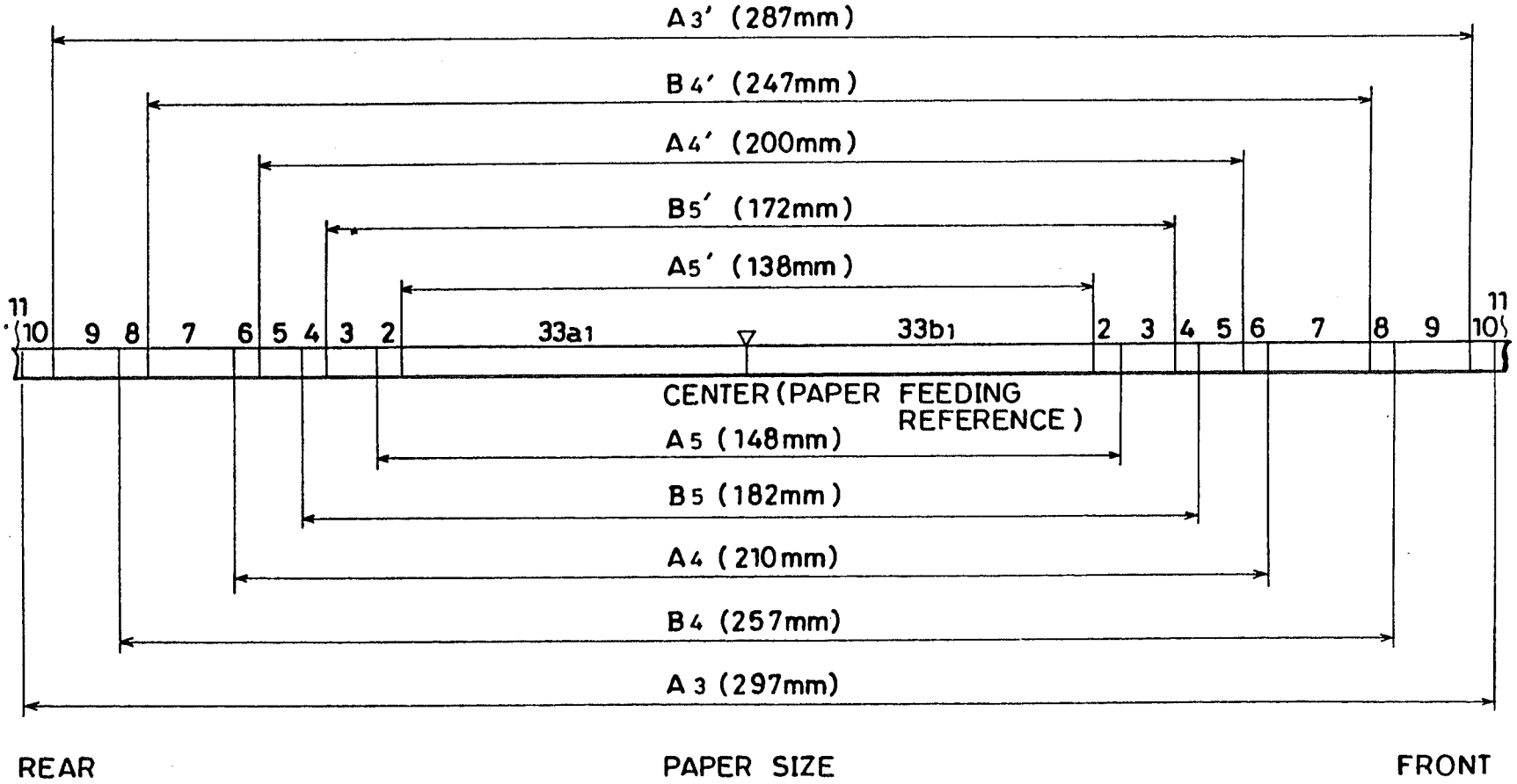
FIG. 12 is a front view of the eraser unit.

Referring to FIG. 12, the eraser unit 32 will be described. The eraser element 33 constituting the eraser unit 32 comprises 11 blocks $33a_1$ to $33a_{11}$ provided on the left side and 11 blocks $33b_1$ to $33b_{11}$ provided on the right side, with the center being the paper feeding reference. Each of the blocks corresponds to the paper size fed breadthwise with the center being the paper feeding reference. More specifically, unexposed zones each having the width of 5 mm are formed on both sides of the sheet of paper. These zones are exposed in accordance with the pattern of the timing of turning on/off of the eraser unit, the interval between the turning on/off, and the pattern of turning on/off of other portions, whereby an index is formed. Therefore, the even numbered blocks from the center correspond to the unexposed zones, the width of which is 5 mm. Referring to FIG. 13, portions which are turned on (marked by O), portions which are kept off (marked by x), portions which are kept off but in the index forming mode and kept on in the index forming mode (marked by Δ) and the portions timing controlled for forming the index (marked by T) are shown for the respective divided blocks.

For example, when an index is formed on a sheet of B4 size, then the portions marked by X⟷X of the blocks $33a_1$ to $33a_7$ and $33b_1$ to $33b_7$ are the original latent electrostatic image portions, so that erasing element is kept off. The block $33a_8$ is a portion for erasing the unexposed zone on one side (marked by Δ) in which the element is kept on only in the index forming mode. The block $33b_8$ is a portion for forming the index by the timing control (marked by T). Other portion marked (O) are portions to be erased with the erase element on.

The formation of indexes will be described in the following using a case in which 10 originals having the size of A3 are copied on sheet of paper having the size of A4 with the index division number m being 10 and the paper feeding velocity v being 100 mm/sec as an example.

At first, the original is set on the platen glass 10 and the original size A3 is designated by the original size key 113. The paper size A4 is designated by the paper size selecting key 112. Consequently, the magnification rate 0.707 is automatically displayed on the magnification rate displaying portion 105. When the index forming mode selecting key 111 is turned on, the magnification rate is changed to the index formation magnification rate 0.673. Thereafter, the index division number m=10 is inputted through the ten keys 103, so that the number "10" is displayed on the number displaying portion 104. When the index division setting key 109 is turned on, "10" is displayed on the index division displaying portion 108*a*. The set number before the selection of mode is returned and displayed at the copy number displaying portion 104. The number indicating the index position is set to "1" by the index position setting key 110. By the setting, the index position "1" is displayed on the index position displaying portion 108*b*. Thereafter, the print key 101 is turned on to start copying. Every time the copying for a prescribed number is completed for one original, a new original is set, and the index position number is set to "2" by the index position setting key 110, and the print button 101 is turned on to carry out copying again.

In this case, the paper size is A4 as shown in FIG. 13, so that the division block of the eraser element 33 which is timing controlled for forming index is $33b_6$.

The index length l will be $$l = (b - 15 \times 2)/m = (297 - 30)/10 = 26.7 \text{ mm} \quad (1)$$

The index forming time interval Tin will be $$Tin = l/v = 26.7/100 = 267 \text{ msec} \quad (2)$$

The index formation starting time Tst (n) will be $$TST(n) = \{15 + l(n-1)\}/v = \{15 + 26.7(n-1)\}/100 \text{ msec} \quad (3)$$

$$(n = 1, 2 \ldots 9, 10)$$

Figure 14:
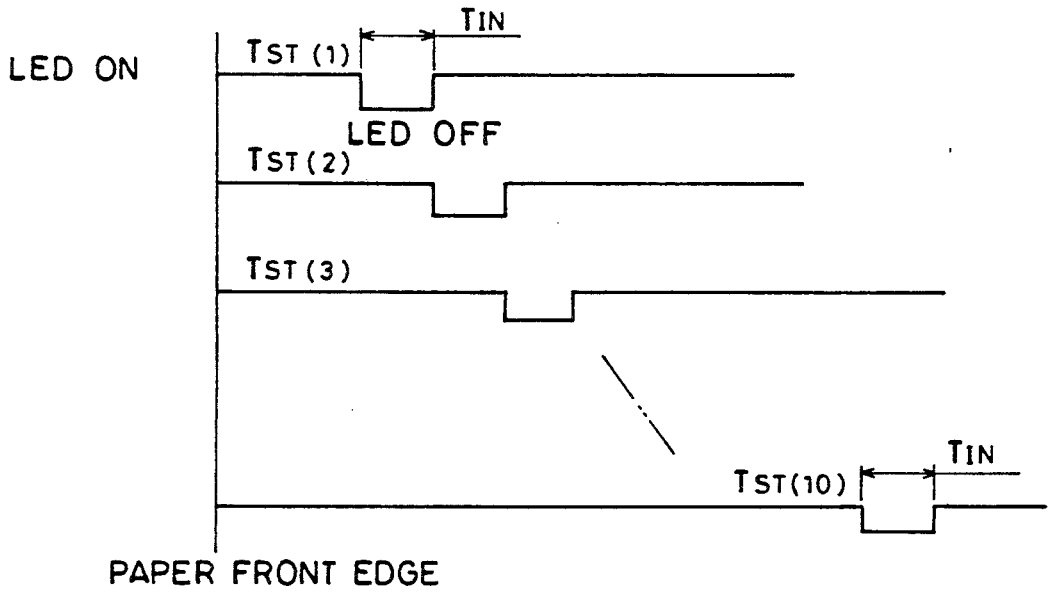
FIG. 14 is a timing chart for forming the index.
Figure 15:
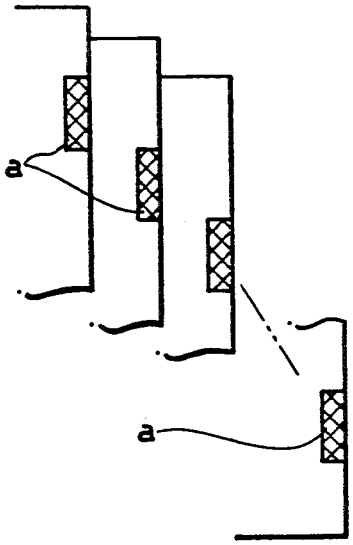
FIGS. 15 and 16 show examples of the indexes formed in accordance with the first embodiment.
Figure 16:
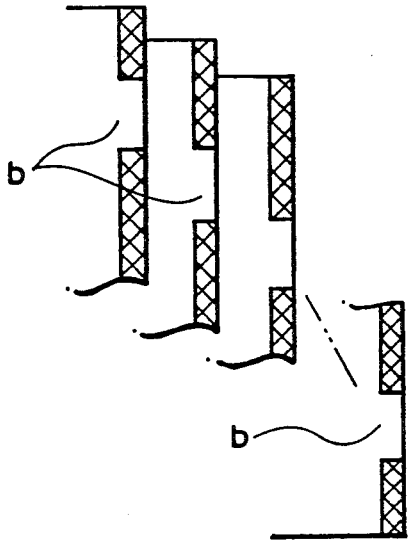

Therefore, the time chart of the division block $33b_6$ of the eraser element 33 for every original is as shown in FIG. 14. The portion of the unexposed zone where the LED is kept off is not erased, so that a black index a is formed (FIG. 15).

In the timing chart of FIG. 14, when the portions of the LED which are kept on/off are inverted, then a white index b with the background being black can be formed, which enables writing of characters and the like.

In the above described embodiment, the center is used as the paper feeding reference position. When one side of the paper is used as the paper feeding reference position, the index can be formed by changing the magnification rate and the division pattern of the erase element 33 of the eraser unit 32.

Figure 17:
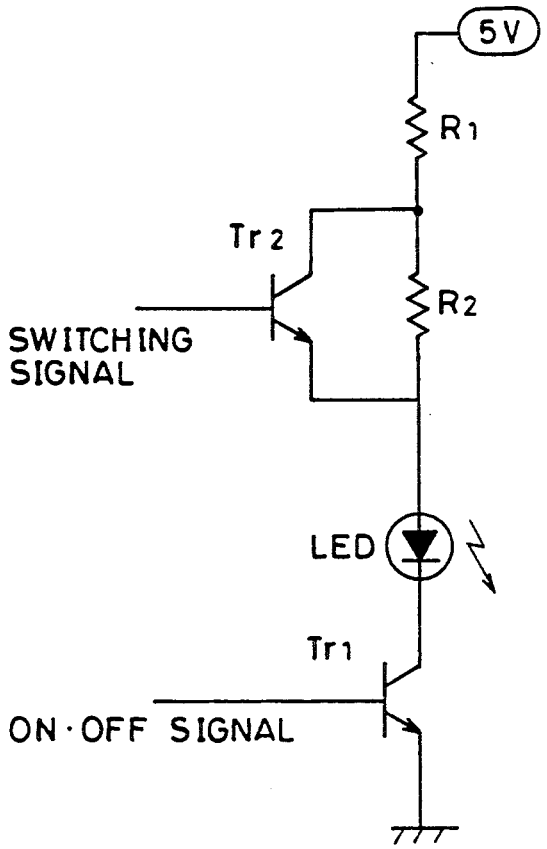
FIG. 17 is a schematic diagram of an index forming circuit.
Figure 18:
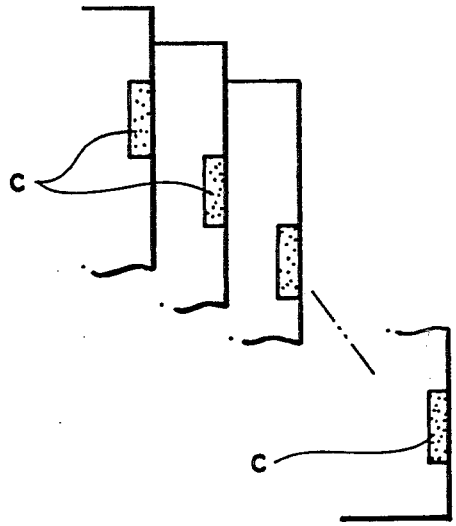
FIG. 18 shows an index of half tone.

As to the division blocks $33b_2$, $33b_4$, $33b_6$, $33b_8$ and $33b_{10}$ of the eraser element 33 of the eraser unit 33 corresponding to the index forming portions of respective paper size, the following structure may be used. Namely, in addition to the LED lighting circuit connecting the transistor Tr1 which is the same as in other division blocks, a light intensity switching circuit (see FIG. 17) connecting a transistor Tr2 is provided, with the intensity of the LED may about half of the normal intensity. Consequently, a half tone index portion can be provided, which was black in the above described embodiment, (FIG. 18). The half tone index portion c enables writing of characters and the like.

(2) Second embodiment

In the first embodiment, an index is formed on one end portion of a sheet of copy paper. In the second embodiment of the present invention, numerals are written at the index portions of the first embodiment. Since some portions of the second embodiment are overlapping with those of the first embodiment, only the different portions will be described in the following.

Figure 19:
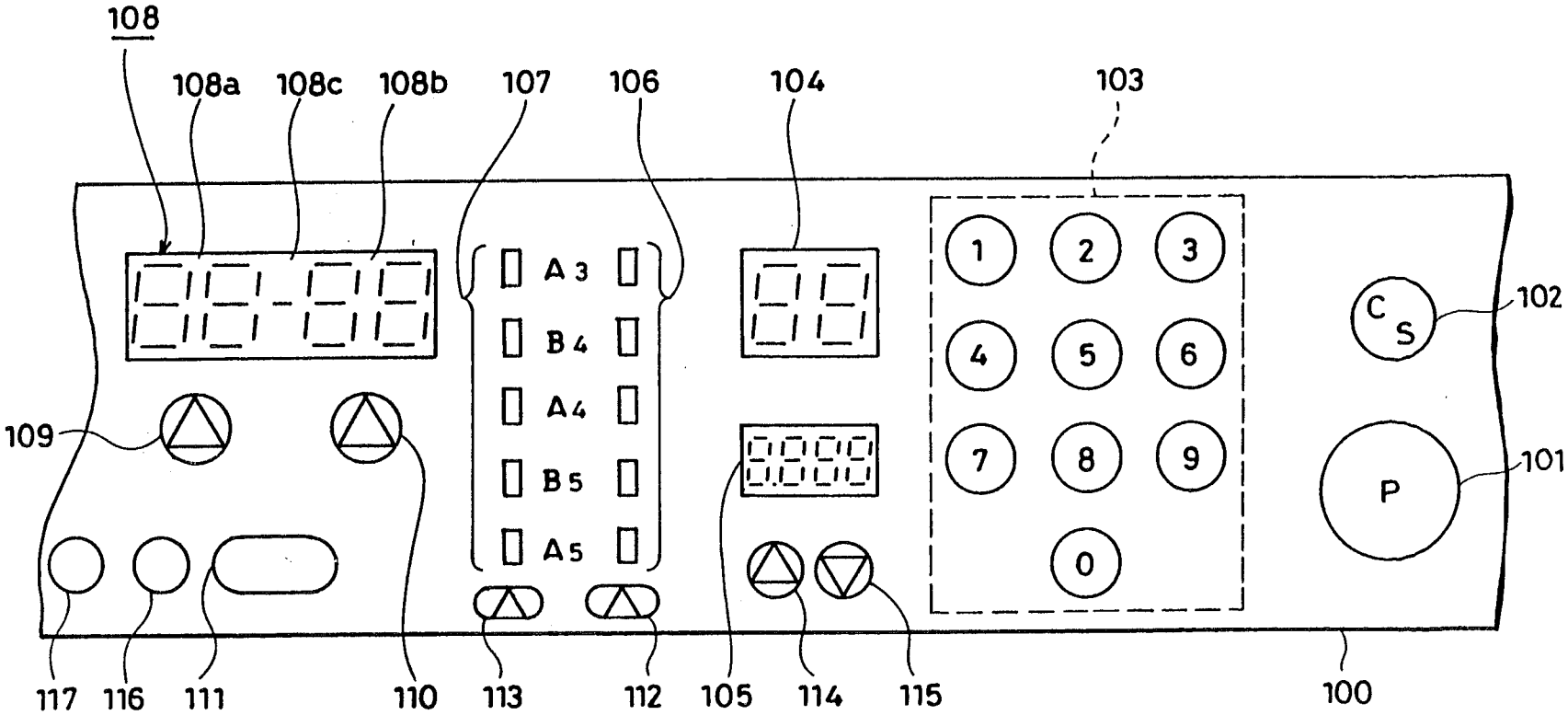
FIG. 19 is a partial plan view of an operation panel in accordance with a second embodiment of the present invention.

Referring to FIG. 19, the operation panel in accordance with the second embodiment of the present invention will be described. This figure corresponds to FIG. 3 of the first embodiment. Compared with FIG. 3, the operation panel of the second embodiment of the present invention further comprises an index page inserting key and an index number inserting key 117. By these keys, the page at which the index number (corresponding to the index position) is inserted and the number to be inserted are set at the index portion of the copy paper.

Figure 20:
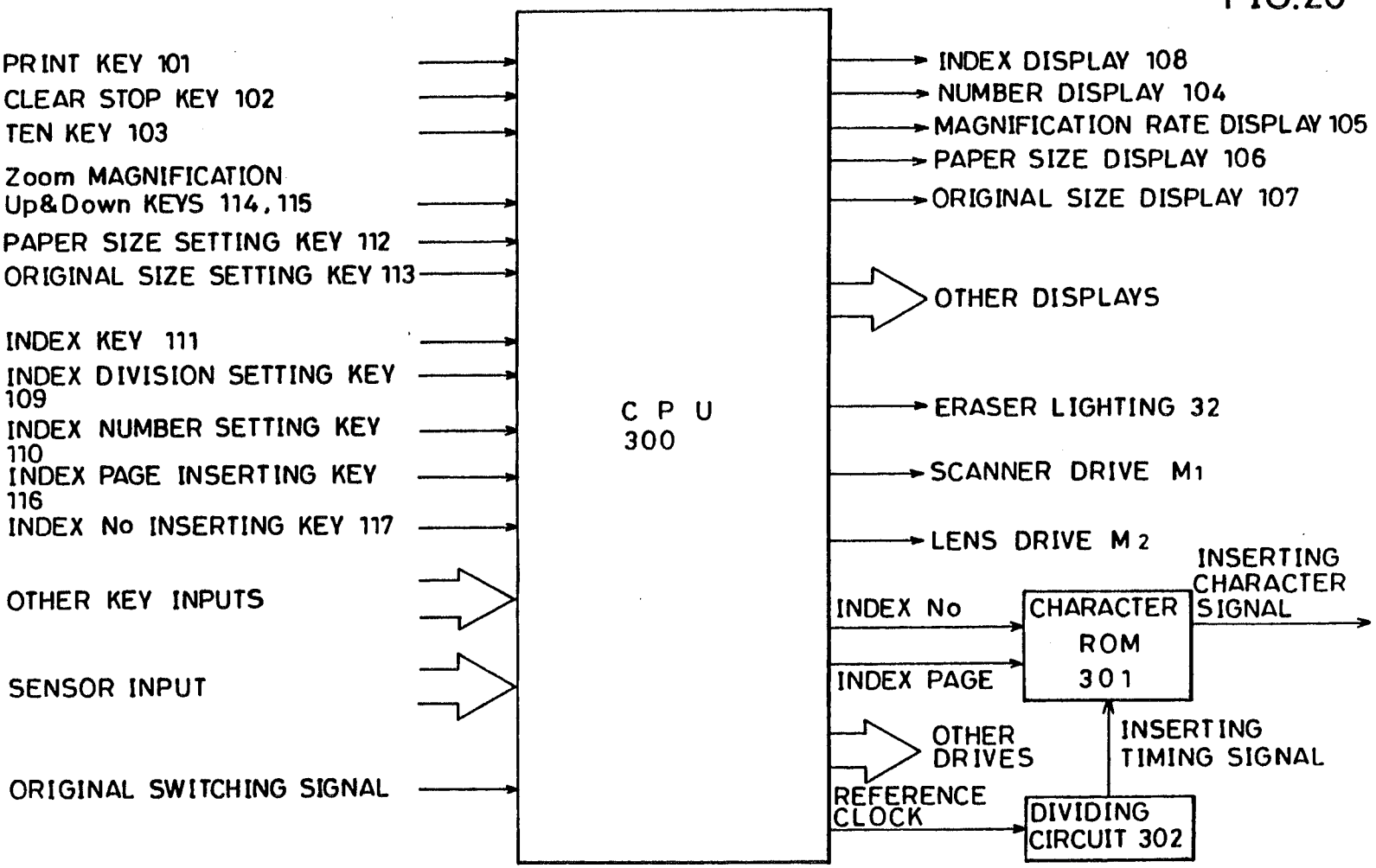
FIG. 20 shows inputs and outputs of signals to and from a CPU in accordance with the second embodiment of the present invention.

Referring to FIG. 20, the input/output signals to and from the CPU300 which is the center of control in the second embodiment of the present invention will be described. In the second embodiment, a character ROM 301 serving as a character generating means and a dividing circuit 302 are connected to the CPU300. Based on the index position and the index page information, the character inserting data are outputted in synchronization with an inserting timing signal of the dividing circuit 302. Other portions except the above described points are all the same as the CPU200 of the first embodiment described with reference to FIG. 4. Therefore, the description is not repeated.

The main routine and others of the control of the CPU300 in the second embodiment are also the same as those in the first embodiment, so that the description is not repeated.

Figure 21A:
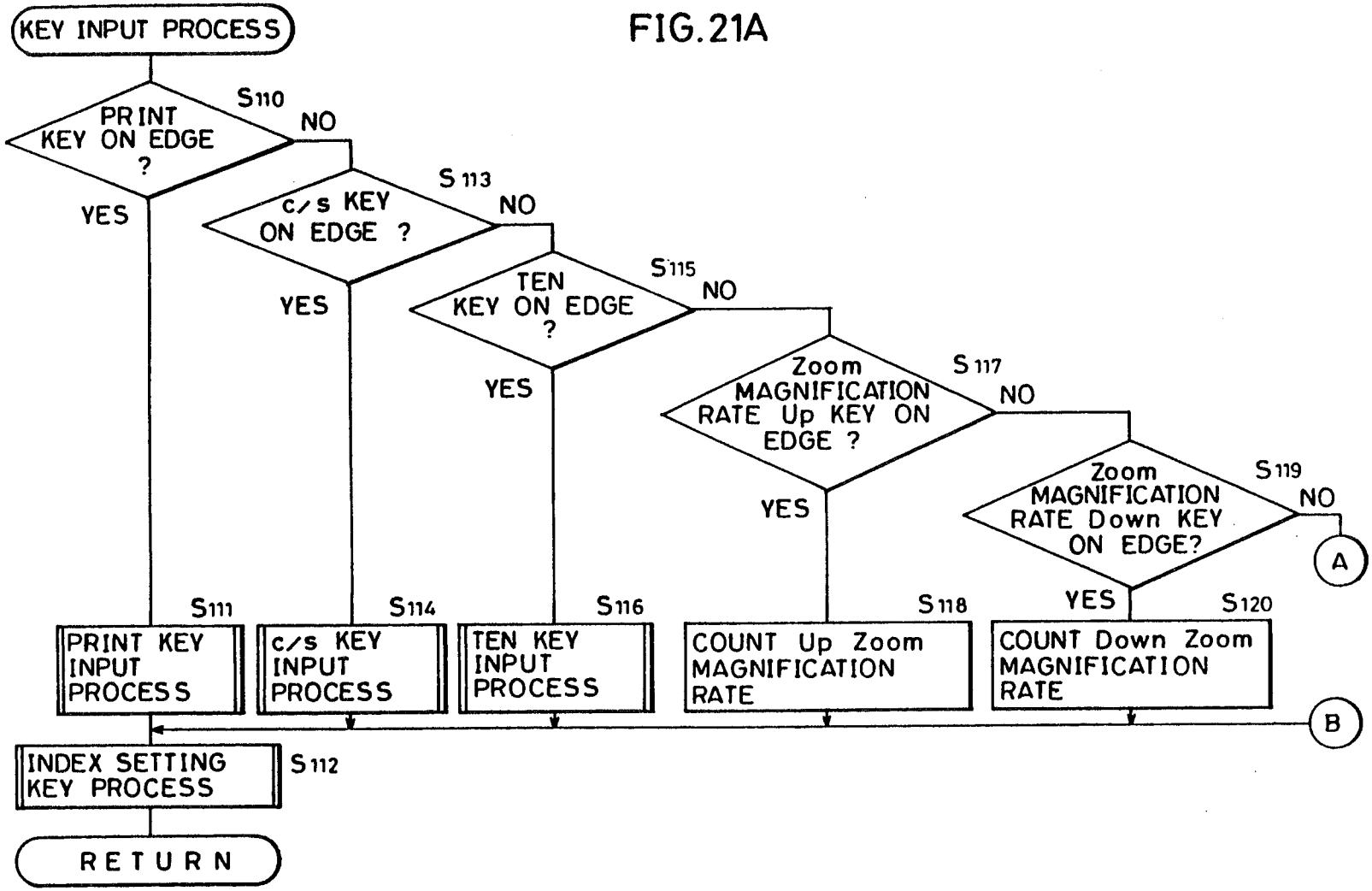
FIGS. 21A, 21B and FIGS. 23 to 25 are flow charts showing the control of the second embodiment of the present invention
Figure 21B:
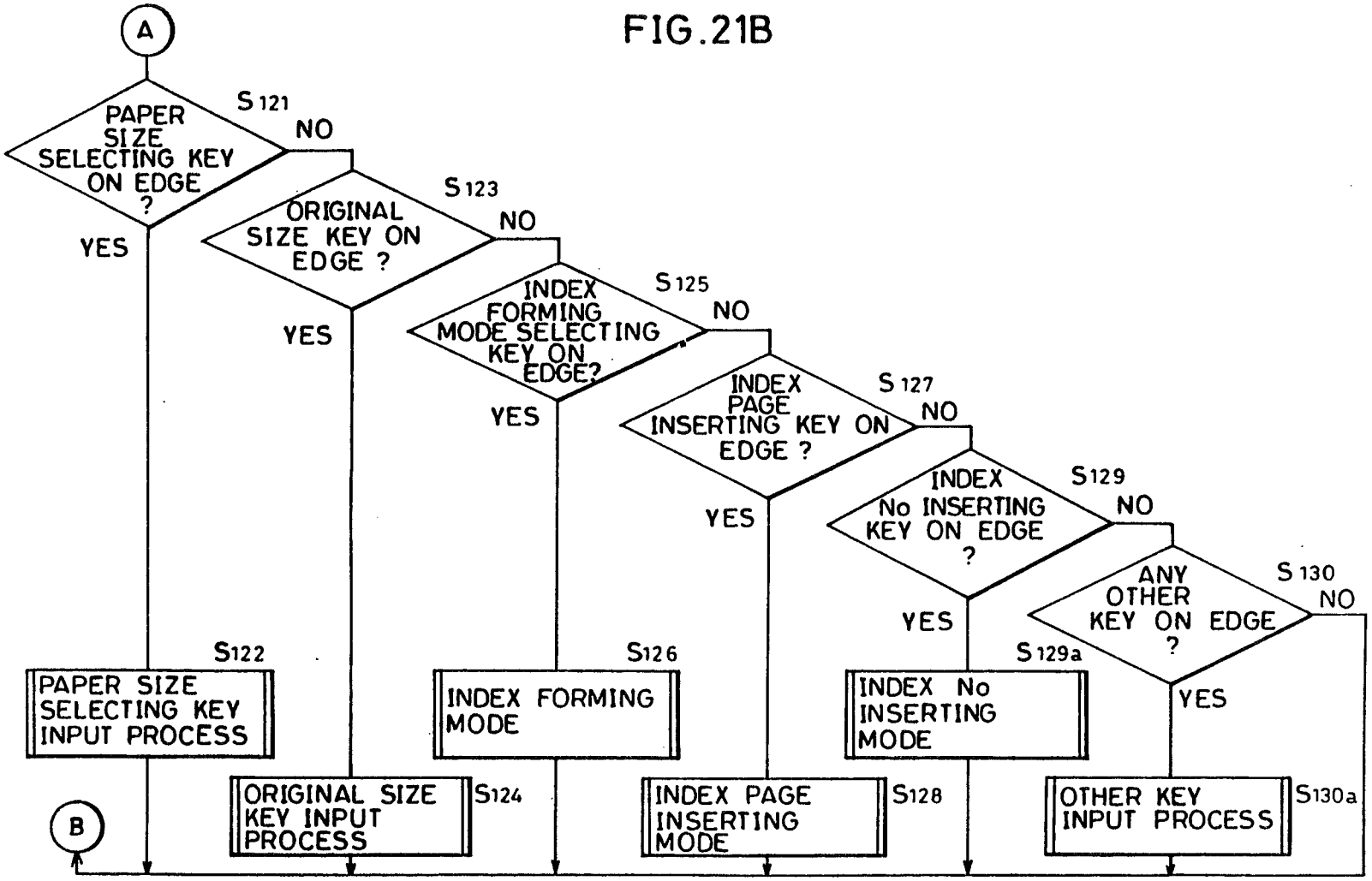

Referring to FIG. 21, a key input process routine in accordance with the second embodiment of the present invention will be described. FIG. 21 corresponds to FIG. 6 described with reference to the first embodiment. The portions shown in FIG. 21A and the steps S121 to S126 and S130 and S130*a* of FIG. 21B are the same as the first embodiment, so that the description is not repeated.

In the steps S127 and S128, the index page inserting mode process is carried out. Before the formation of the index, the index page information is transmitted to the character ROM 301.

In the steps S129 and S129*a*, the index number inserting mode process is carried out. Before the formation of the index, the index number information is transmitted to the character ROM 301. The features which may be selected by choosing between the index number inserting mode and the index page inserting mode are described in the following paragraphs. In the index page inserting mode, the number to be printed on the index portion is updated every time the print key is pressed. However, in this mode, the positions of insertion is not changed.

In the index number inserting mode, both the number to be printed and the position of insertion are updated every time the print key is pressed.

Figure 22B:
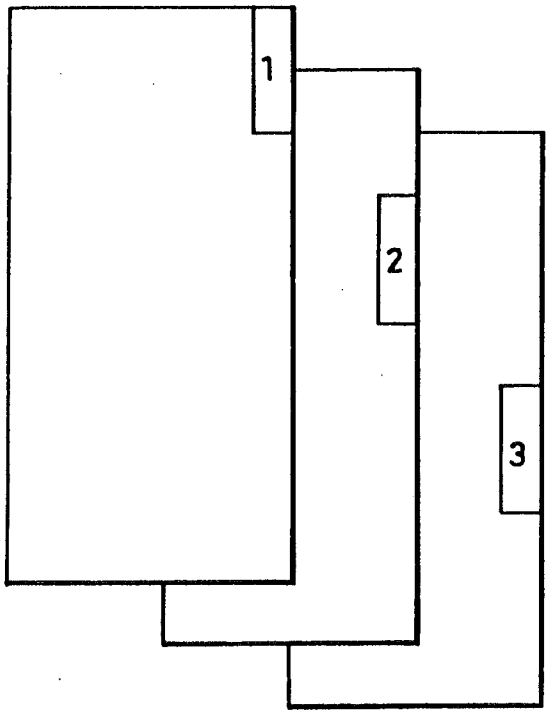
FIGS. 22A and 22B show examples of indexes in accordance with the second embodiment of the present invention.
Figure 22A:
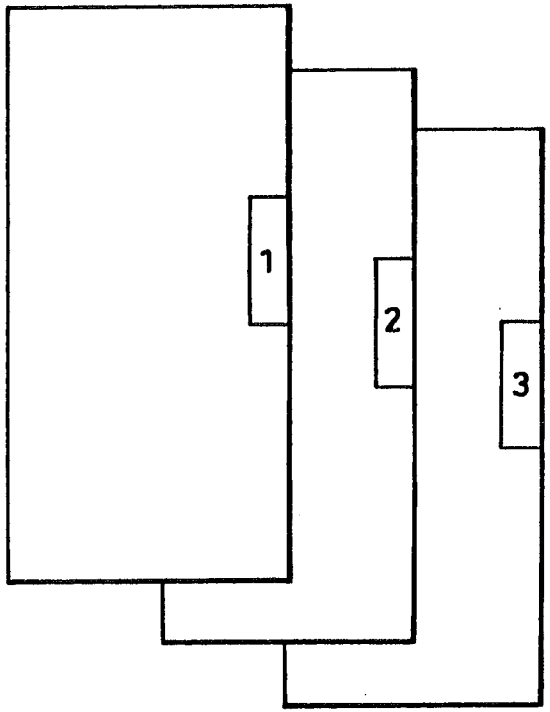

The examples of the indexes provided by the index page inserting mode and the index position inserting mode are shown in FIGS. 22A and 22B, respectively.

Figure 23:
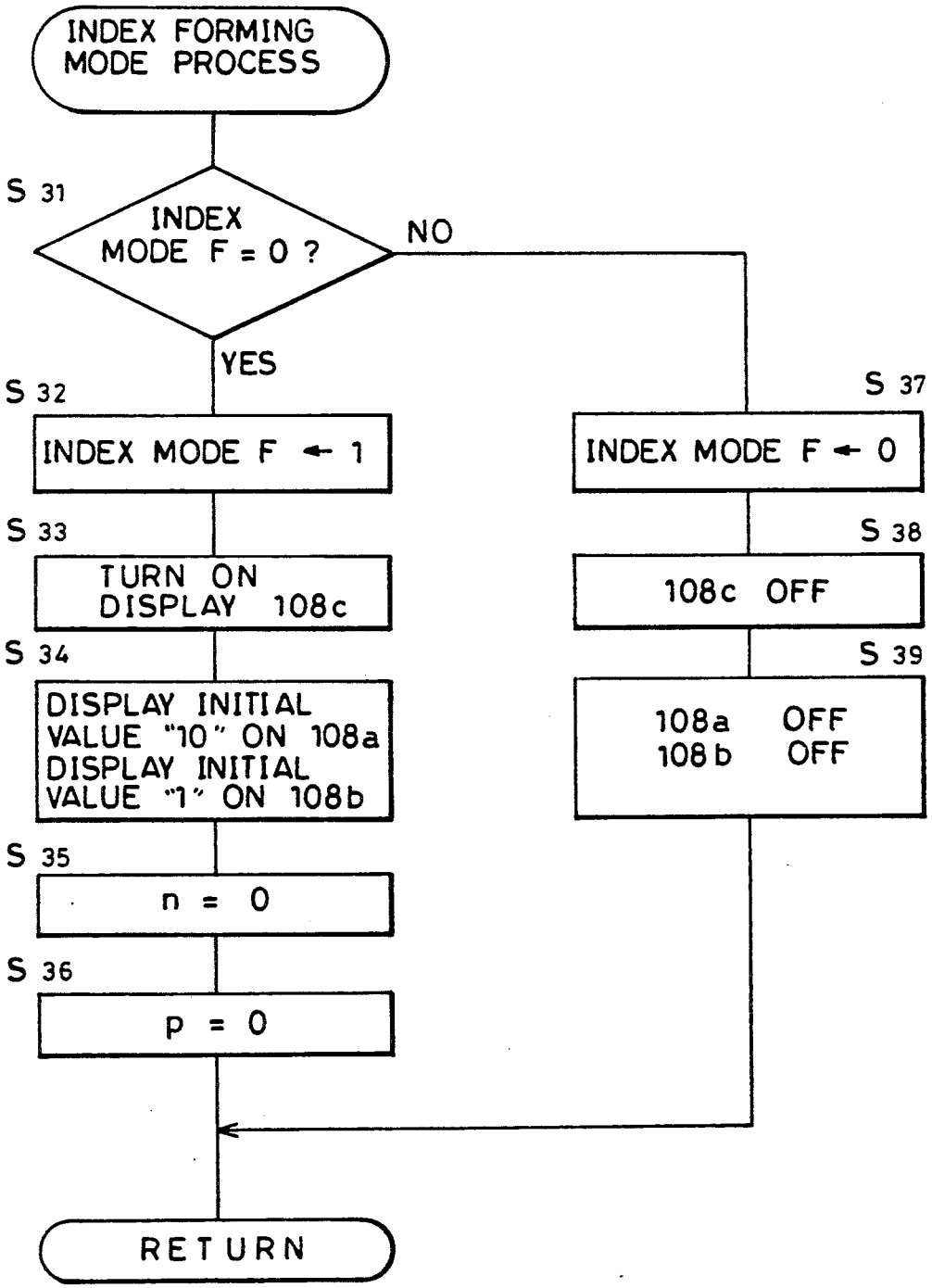

Referring to FIG. 23, the index forming mode process in the second embodiment of the present invention will be described. This figure corresponds to FIG. 7 of the first embodiment. Compared with FIG. 7, the steps S35 and S36 are newly added in the second embodiment. By the addition of these steps S35 and S36, the index numbers are inserted starting from the uppermost position of the sheet of copy paper in the index number inserting mode.

The index set key process in the second embodiment of the present invention will be described with reference to FIG. 24. This figure corresponds to FIG. 8 of the first embodiment.

Figure 8:
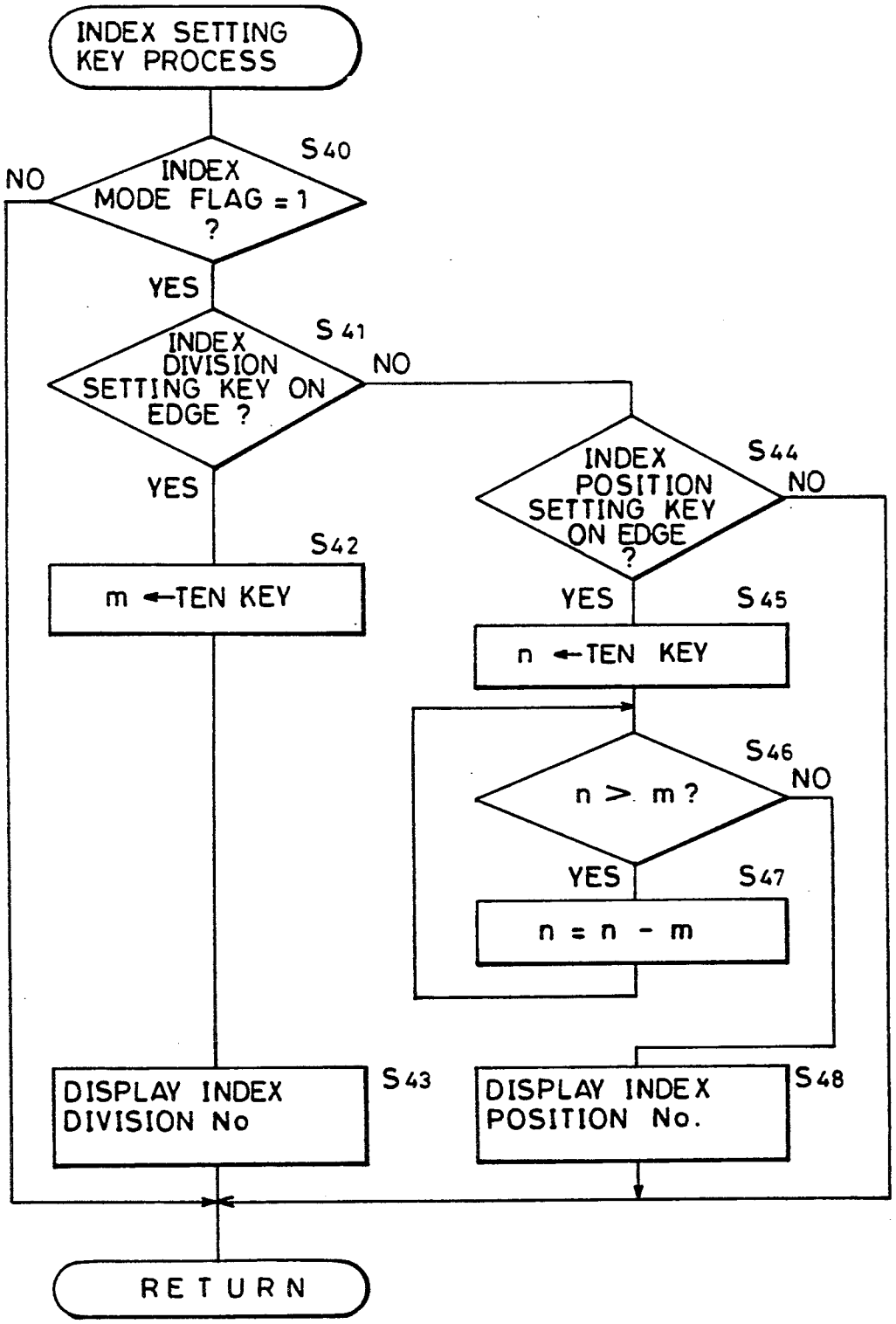
Figure 24:
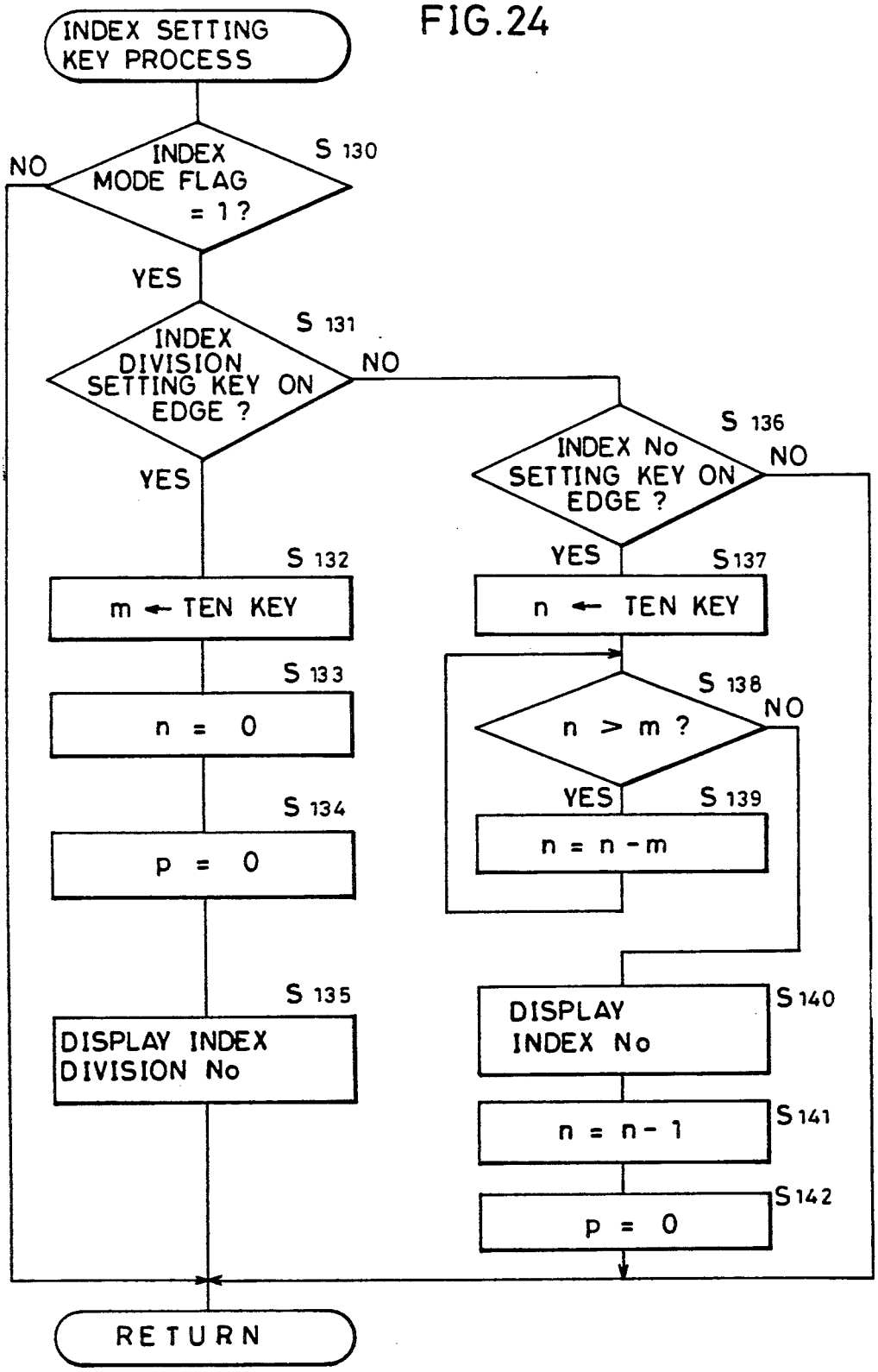

Referring to FIG. 24, the steps S130 to S132 are the same as FIG. 8. In S133, the index position n is initialized and, in S134, the index page p is initialized. The index page p represents a variable indicating the number to be provided on the index portion, the initial value of which is 1. The steps S141 and S142 are added so as to insert the index numbers starting from the uppermost position of the sheet of copy paper in the index number inserting mode. The steps S135 to S140 are the same as in the first embodiment, so that the description is not repeated.

Figure 25:
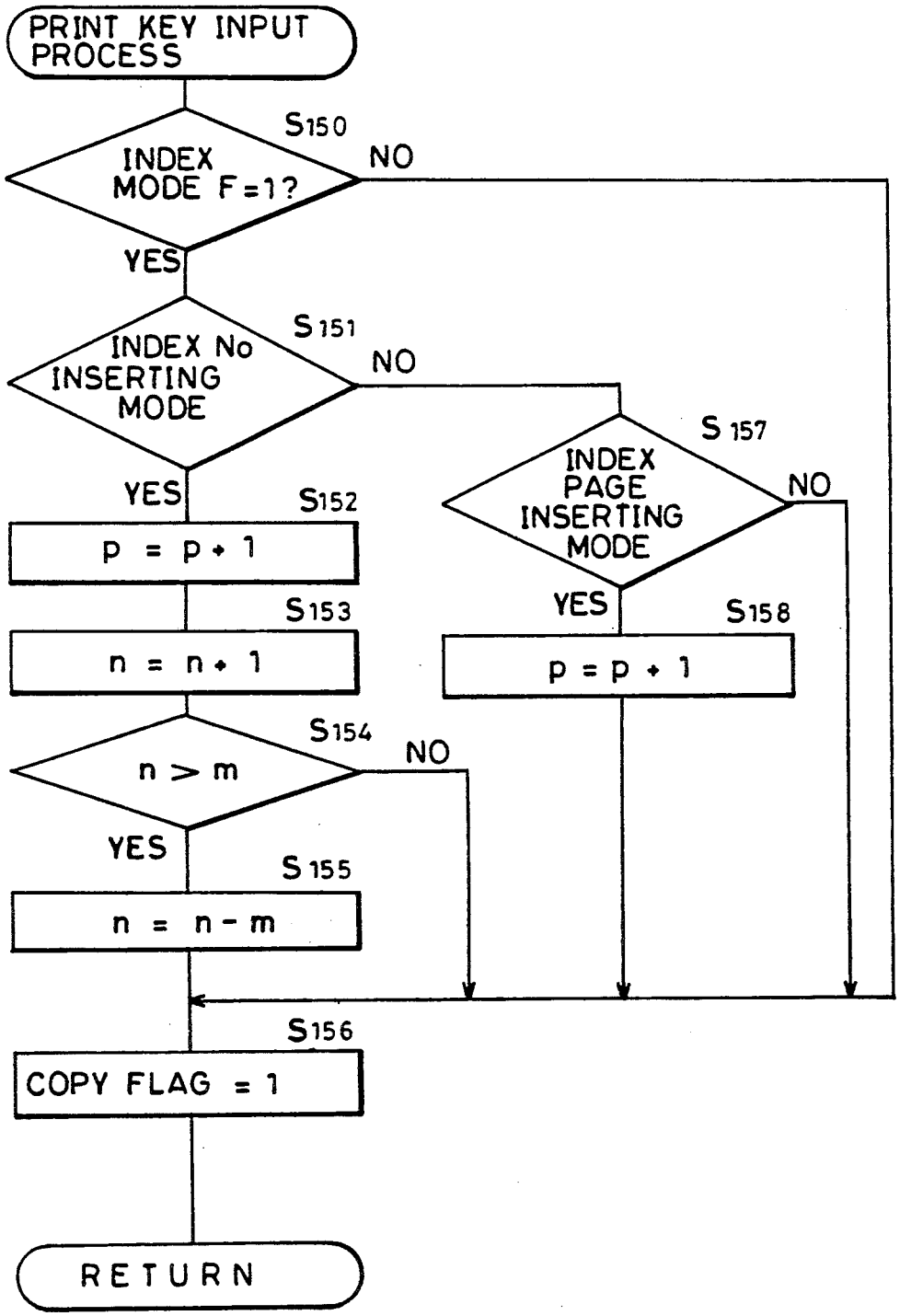

FIG. 25 is a flow chart showing a print key input process routine. In the first embodiment, the index page was not inserted at the index position during the print key input process, and therefore the detailed description was omitted. However, in the second embodiment, the index page p is inserted at the index position n. Therefore, the details will be described in the following.

In S150, whether or not the index mode flag is set is determined. If the flag is set, the program proceeds to S151 in which whether or not it is the index number inserting mode is checked. If it is the index number inserting mode, then 1 is added to the index page p and the index position n corresponding to the index number, respectively (S152, S153), and the program proceeds to S154. The index position n must be no more than the index division number m, as described in the first embodiment. Therefore, the magnitude of the values n and m are compared in S154. If $n>m$, then the value n is set to be $n=n-m$, so as to prevent erroneous setting of the index number.

If it is determined that it is not the index number inserting mode in S151, then, whether or not it is the index page inserting mode is determined in S157. If it is YES in S157, then the program proceeds to S158 in which the value of the index page p is carried.

When the above described processes are executed, or when the index mode flag is not set (NO in S150), or when the index position and the index page are not inserted although the index mode flag is set (NO in S151 and S157), then the program proceeds to S156 in which the copy flag is set for starting copying. The copy flag is reset to "0" after the normal completion of the copying operation in the step of other processes (S7 in FIG. 5).

A method of writing a number at the white index portion b described with reference to FIG. 15 of the first embodiment will be described in the following.

Figure 26:
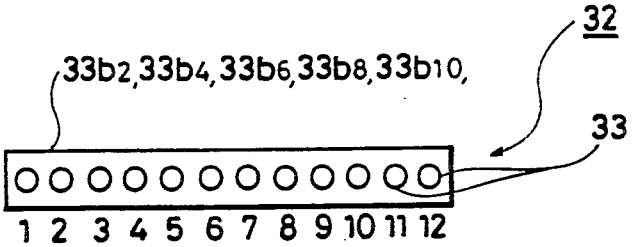
FIG. 26 is a front view of an erasing element in an index forming portion in accordance with the second embodiment of the present invention.
Figure 27:
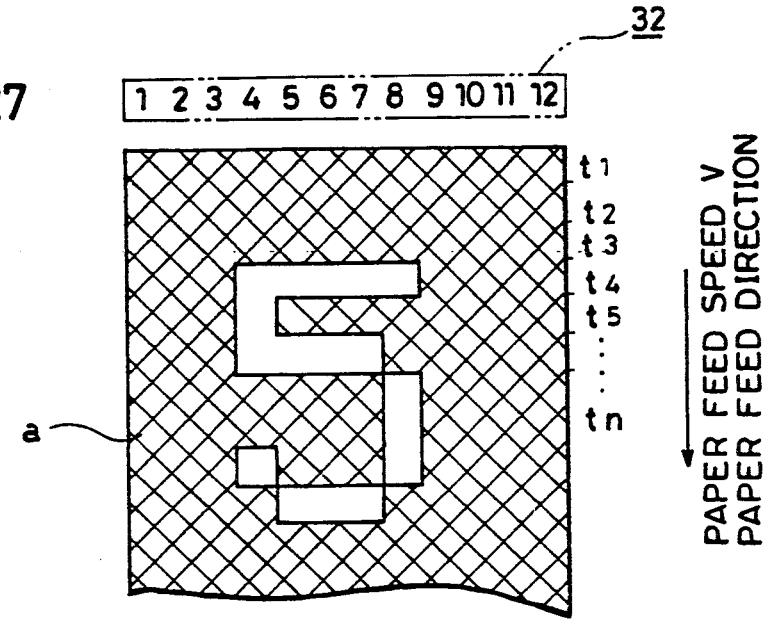
FIGS. 27 and 28 show the indexes in accordance with the second embodiment of the present invention.
Figure 28:
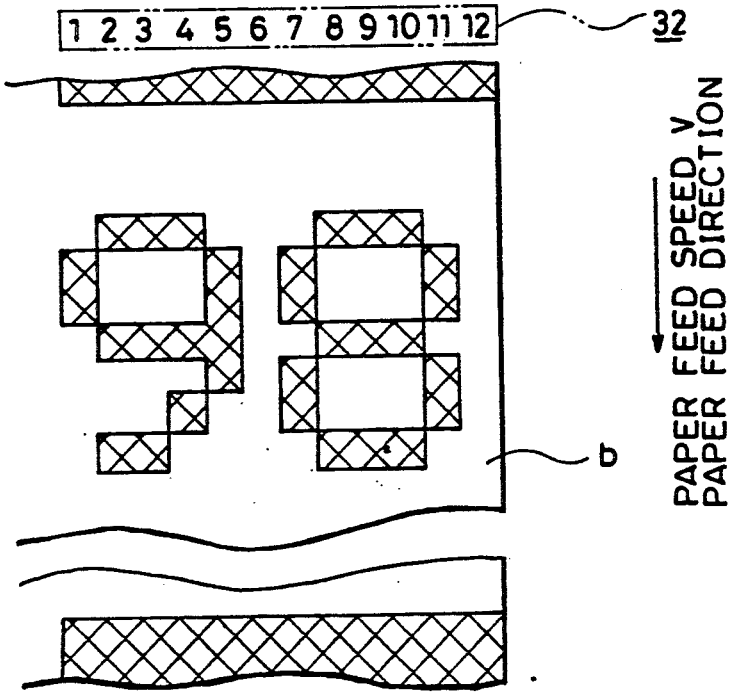

In the second embodiment, the blocks $33b_2$, $33b_4$, $33b_6$, $33b_8$ and $33b_{10}$ of the eraser element constituting the eraser unit 32, described with reference to FIG. 12 and FIG. 1 are further divided into 12, as shown in FIG. 26. Based on the index number information or the index page information transmitted from the CPU 300 to the character ROM 301, an inserting character signal in synchronization with the inserting timing signal tn provided by dividing reference clock are transmitted to the element 33. The eraser elements 33 divided into 12 are controlled to be turned ON/OFF by the character signal in the off timing Tin of the timing chart of FIG. 14. For example, in the case of the inserting timing signal T4, the fourth, fifth, sixth, seventh and eighth elements out of the 12 divided elements are turned on, and successively, only the fourth one is turned on at t5, and by this control of the turning ON/OFF, black index a is formed. At the same time, the index number or the index page is inserted white (FIG. 27). If the timing of the turning ON/OFF of the LEDs constituting the eraser element 33 is inverted and the turning on/off is controlled by the character signal in the on timing Din, then black index number or black index page can be inserted to the white index portion b, as shown in FIG. 28.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image forming apparatus for forming an image on a paper, comprising:

a photoreceptor having a photosensitive layer thereon;

means for charging said photoreceptor;

means for exposing said image on said photoreceptor so as to form a first latent electrostatic image on said photoreceptor;

means for setting magnification rate of said exposing means;

means for selecting a first mode in which said image is exposed on said photoreceptor in said set magnification rate and a second mode in which said image is exposed on said photoreceptor in a magnification rate smaller than said set magnification rate so that an unexposed portion is formed at a peripheral portion of said photoreceptor;

means for partially removing, when said second mode is selected, charge at the unexposed portion formed on said photoreceptor to form a second latent electrostatic image;

means for developing said first and second latent electrostatic images to provide first and second visible images; and means for transferring the first and second visible images onto said paper.

2. A copying apparatus for forming an image of an original placed on a platen onto a copy paper, comprising:

a photoreceptor having photosensitive layer thereon;

means for charging said photoreceptor;

means for exposing the image of said original on said photoreceptor so as to form a latent electrostatic image on said photoreceptor;

means for setting a copying magnification rate of said exposing means;

means for selecting a first mode in which said image of the original is exposed on the photoreceptor in said set magnification rate and a second mode in which the image of said original is exposed on said photoreceptor in a magnification rate smaller than said set copying magnification rate so that an unexposed portion is formed at the peripheral portion of said photoreceptor;

means for removing, when said second mode is selected, some of the charges at the unexposed portion to form another latent electrostatic image at the unexposed portion for an index;

developing means for developing the latent electrostatic image formed on said photoreceptor and the latent electrostatic image for the index adjacent thereto into toner images; and means for transferring said toner images on said copy paper.

3. A copying apparatus according to claim 2, wherein said exposure means comprises a lamp for illuminating the original on said platen, an optical system guiding light reflected from said original to said photoreceptor, and scanning means for relatively moving the original with respect to said optical system.

4. A copying apparatus according to claim 3, wherein said scanner is moved in a prescribed first direction, and said latent electrostatic image for the index is formed beside the latent electrostatic image of said original along the scanning direction.

5. A copying apparatus according to claim 2, wherein said removing means comprises light emitting means for removing charges on said photoreceptor; and control means for controlling said light emitting means to turn on at a prescribed timing and for a prescribed time period.

6. A copying apparatus according to claim 5, wherein said removing means further comprises character generating means for outputting a character generating signal for generating a prescribed character, and said controlling means controls said light emitting means in synchronization with the character generating signal.

7. A copying apparatus according to claim 5, wherein said exposure means comprises a lamp for illuminating the original on said platen, an optical system for guiding light reflected from said original to said photoreceptor, and scanning means for relatively moving the original with respect to said optical system.

8. A copying apparatus according to claim 7, wherein said scanner is moved in a prescribed first direction, and the latent electrostatic image for said index is formed beside the latent electrostatic image of said original along the scanning direction.

9. A copying apparatus for forming an image of an original placed on a platen onto a copy paper, comprising:

a photoreceptor;

means for charging said photoreceptor;

means for exposing the image of said original on said photoreceptor;

a latent electrostatic image formed on said photoreceptor by said exposure;

means for setting a copying magnification rate of said exposing means;

means for partially removing charges on said photoreceptor;

means for setting an index forming mode in which a first latent electrostatic image corresponding to the original image and a second latent electrostatic image for index are formed on the photoreceptor;

controlling means, when said index forming mode is set, for controlling said exposure means such that the image of said original is exposed to said photoreceptor in a magnification rate smaller than said set copying magnification rate and for controlling said removing means for partially removing the charges which remain at a side portion of the first latent electrostatic image, the second latent electrostatic image for said index being formed at said side portion;

means for developing the first latent electrostatic image and the second latent electrostatic image for the index into toner images; and means for transferring said developed toner images onto said copy paper.

10. A copying apparatus according to claim 9, wherein said index has a prescribed width, and said index forming mode setting means includes width changing means for changing the width of said index.

11. A copying apparatus according to claim 10, wherein said index forming mode setting means comprises position changing means for changing the position of said index.

12. A copying apparatus for forming an image of an original placed on a platen to a copy paper, comprising:

a photoreceptor;

means for charging said photoreceptor;

erasing means including a plurality of light emitting elements for partially removing charges on said photoreceptor;

means for exposing the image of said original to said photoreceptor, a first latent electrostatic image being formed on said photoreceptor;

means for setting copying magnification rate of said exposing means;

means for selecting a first mode in which the image of said original is exposed to said photoreceptor in said set copying magnification rate, and a second mode in which the image of said original is exposed to said photoreceptor in a magnification rate smaller than said set copying magnification rate, an unexposed portion being formed on said photoreceptor adjacent to said first latent image in said second mode;

character generating means for generating a character;

means for forming, when said second mode is selected, a second latent electrostatic image by controlling said erasing means in synchronization with a character generating signal from said character generating means to partially remove the charges at said unexpected portion;

means for developing said first and second latent electrostatic images formed on said photoreceptor into toner images; and means for transferring said developed toner images onto said copy paper, whereby an index is formed by said second latent electrostatic image.

13. A copying apparatus according to claim 12, further comprising:

a copy operation starting button for starting the operation of said copying apparatus, wherein said character generating means generates a plurality of different characters, and said plurality of characters are updated every time said copying operation starting button is pressed.

14. A copying apparatus according to claim 13, wherein said index has a prescribed width, and said selecting means includes width changing means for changing the width of said index.

15. A copying apparatus according to claim 13, wherein said selecting means comprises position changing means for changing the position of said index.

16. A method for forming an image by using an image forming apparatus having a photoreceptor forming a latent electrostatic image of an original image, comprising the the steps of charging said photoreceptor;

setting a copying magnification rate of said image;

exposing the image of said original on said photoreceptor in a magnification rate smaller than said set copying magnification rate in order to form a latent electrostatic image corresponding to the image of said original on said photoreceptor;

partially removing charges at an unexposed portion adjacent to said latent electrostatic image formed on said photoreceptor to form a latent electrostatic image for an index adjacent to said latent electrostatic image;

developing said latent electrostatic image corresponding to the image of said original and the latent electrostatic image for said index; and transferring the developed toner images to said copy paper.

* * * * *

UNITED STATES PATENT AND TRADEMARK OFFICE

CERTIFICATE OF CORRECTION

ATENT NO. : 5,150,159

ATED : September 22, 1992

NVENTOR(S) : Shoji Igawa, et al.

It is certified that error appears in the above-identified patent and that said Letters Patent is hereby orrected as shown below:

In Col. 10, line 23, after "key", insert --116--.

In Col. 14, line 62 (Claim 12, line 29), change "unexpected" to --unexposed--.

Signed and Sealed this

Twenty-eighth Day of September, 1993

Bruce Lehman

*Attest:*

BRUCE LEHMAN

*Attesting Officer*

*Commissioner of Patents and Trademarks*